US007473128B2

(12) United States Patent
Montena

(10) Patent No.: US 7,473,128 B2
(45) **Date of Patent: *Jan. 6, 2009**

(54) CLAMPING AND SEALING MECHANISM WITH MULTIPLE RINGS FOR CABLE CONNECTOR

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/013,218

(22) Filed: Jan. 11, 2008

(65) Prior Publication Data

US 2008/0113554 A1 May 15, 2008

Related U.S. Application Data

(63) Continuation of application No. 10/972,989, filed on Oct. 25, 2004, now Pat. No. 7,329,149, which is a continuation-in-part of application No. 10/764,782, filed on Jan. 26, 2004, now Pat. No. 6,808,415.

(51) Int. Cl.
*H01R 9/05* (2006.01)

(52) U.S. Cl. ..... 439/584; 439/578

(58) Field of Classification Search ..... 439/462, 439/578, 583, 584, 585

See application file for complete search history.

(56) References Cited

U.S. PATENT DOCUMENTS

| | | | |
|---|---|---|---|
| 2,258,737 | A | 10/1941 | Browne |
| 2,785,384 | A | 3/1957 | Wickesser |
| 3,022,482 | A | 2/1962 | Waterfield et al. |
| 3,076,169 | A | 1/1963 | Blaisdell |
| 3,184,706 | A | 5/1965 | Atkins |
| 3,275,913 | A | 9/1966 | Blanchard |
| 3,355,698 | A | 11/1967 | Keller |
| 3,406,373 | A | 10/1968 | Forney, Jr. |
| 3,498,647 | A | 3/1970 | Schroder |
| 3,581,269 | A | 5/1971 | Frey et al. |
| 3,629,792 | A | 12/1971 | Dorell |
| 3,671,922 | A | 6/1972 | Zerlin et al. |
| 3,671,926 | A | 6/1972 | Nepovim |
| 3,686,623 | A | 8/1972 | Nijman et al. |
| 3,710,005 | A | 1/1973 | French |
| 3,744,011 | A | 7/1973 | Blachenot et al. |
| 3,757,279 | A | 9/1973 | Winston |
| 3,845,453 | A | 10/1974 | Hemmer |

(Continued)

FOREIGN PATENT DOCUMENTS

| | | |
|---|---|---|
| DE | 1191880 | 4/1965 |

(Continued)

*Primary Examiner*—Thanh-Tam T Le
(74) *Attorney, Agent, or Firm*—Marjama Muldoon Blasiak & Sullivan LLP

(57) ABSTRACT

A coaxial cable connector includes a connector body, a mandrel disposed inside the connector body and a compression member radially adjacent to one end of the connector body. A plurality of inner rings and at least one outer ring are interleaved in a wedging relationship inside the connector body outside a portion of a mandrel. As the compression member is axially advanced, the inner and outer rings are driven into a wedging engagement between the coaxial cable and the connector body. At least one of the inner rings is composed of a deformable material which when compressed forms a continuous seal with the coaxial cable.

19 Claims, 22 Drawing Sheets

U.S. PATENT DOCUMENTS 3,915,539 A 10/1975 Collins et al.
3,936,132 A 2/1976 Hutter
3,985,418 A 10/1976 Spinner et al.
4,046,451 A 9/1977 Juds et al.
4,053,200 A 10/1977 Pugner
4,059,330 A 11/1977 Shirey
4,126,372 A 11/1978 Hashimoto et al.
4,156,554 A 5/1979 Aujla et al.
4,168,921 A 9/1979 Blanchard
4,173,385 A 11/1979 Fenn et al.
4,227,765 A 10/1980 Neumann et al.
4,280,749 A 7/1981 Hemmer
4,339,166 A 7/1982 Dayton
4,346,958 A 8/1982 Blanchard
4,354,721 A 10/1982 Luzzi
4,373,767 A 2/1983 Cairns
4,400,050 A 8/1983 Hayward
4,408,821 A 10/1983 Forney, Jr.
4,408,822 A 10/1983 Nikitas
4,421,377 A 12/1983 Spinner et al.
4,444,453 A 4/1984 Kirby et al.
4,484,792 A 11/1984 Tengler et al.
4,533,191 A 8/1985 Blackwood
4,545,637 A 10/1985 Bosshard et al.
4,557,546 A 12/1985 Dreyer
4,575,274 A 3/1986 Hayward
4,583,811 A 4/1986 McMills
4,596,435 A 6/1986 Bickford
4,600,263 A 7/1986 DeChamp et al.
4,614,390 A 9/1986 Baker et al.
4,645,281 A 2/1987 Burger
4,650,228 A 3/1987 McMills et al.
4,655,159 A 4/1987 McMills
4,660,921 A 4/1987 Hauver
4,668,043 A 5/1987 Saba et al.
4,674,818 A 6/1987 McMills et al.
4,676,577 A 6/1987 Szegda
4,684,201 A 8/1987 Hutter
4,691,976 A 9/1987 Cowen
4,738,009 A 4/1988 Down et al.
4,746,305 A 5/1988 Nomura et al.
4,747,786 A 5/1988 Hayashi et al.
4,755,152 A 7/1988 Elliot et al.
4,789,355 A 12/1988 Lee
4,806,116 A 2/1989 Ackerman
4,813,886 A 3/1989 Roos et al.
4,824,401 A 4/1989 Spinner et al.
4,834,675 A 5/1989 Samchisen
4,854,893 A 8/1989 Morris
4,857,014 A 8/1989 Alf et al.
4,869,679 A 9/1989 Szegda
4,892,275 A 1/1990 Szegda
4,902,246 A 2/1990 Samchisen
4,906,207 A 3/1990 Banning et al.
4,923,412 A 5/1990 Morris
4,925,403 A 5/1990 Zorzy
4,929,188 A 5/1990 Lionetto et al.
4,973,265 A 11/1990 Heeren et al.
4,990,104 A 2/1991 Schieferly
4,990,105 A 2/1991 Karlovich
4,990,106 A 2/1991 Szegda
5,002,503 A 3/1991 Campbell et al.
5,011,432 A 4/1991 Sucht et al.
5,021,010 A 6/1991 Wright
5,024,606 A 6/1991 Ming-Hwa et al.
5,037,328 A 8/1991 Karlovich
5,062,804 A 11/1991 Jamet et al.
5,066,248 A 11/1991 Gaver, Jr. et al.
5,073,129 A 12/1991 Szegda
5,083,943 A 1/1992 Tarrant
5,127,853 A 7/1992 McMills et al.
5,131,862 A 7/1992 Gershfeld
5,141,451 A 8/1992 Down
5,181,161 A 1/1993 Hirose et al.
5,195,906 A 3/1993 Szegda
5,205,761 A 4/1993 Nilsson et al.
5,207,602 A 5/1993 McMills et al.
5,217,391 A 6/1993 Fisher, Jr.
5,217,393 A 6/1993 Del Negro et al.
5,269,701 A 12/1993 Leibfried, Jr.
5,283,853 A 2/1994 Szegda
5,295,864 A 3/1994 Birch et al.
5,316,494 A 5/1994 Flanagan et al.
5,322,454 A 6/1994 Thommen
5,338,225 A 8/1994 Jacobsen et al.
5,340,332 A 8/1994 Nakajima et al.
5,342,218 A 8/1994 McMills et al.
5,352,134 A 10/1994 Jacobsen et al.
5,354,217 A 10/1994 Gabel et al.
5,371,819 A 12/1994 Szegda
5,371,821 A 12/1994 Szegda
5,371,827 A 12/1994 Szegda
5,393,244 A 2/1995 Szegda
5,431,583 A 7/1995 Szegda
5,435,745 A 7/1995 Booth
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,494,454 A 2/1996 Johnsen et al.
5,501,616 A 3/1996 Holliday
5,525,076 A 6/1996 Down
5,542,861 A 8/1996 Anhalt et al.
5,548,088 A 8/1996 Gray et al.
5,571,028 A 11/1996 Szegda
5,586,910 A 12/1996 Del Negro et al.
5,598,132 A 1/1997 Stabile
5,607,325 A 3/1997 Toma
5,651,698 A 7/1997 Locati et al.
5,651,699 A 7/1997 Holliday
5,662,489 A 9/1997 Stirling et al.
5,667,405 A 9/1997 Holliday
5,785,554 A 7/1998 Ohshiro et al.
5,795,188 A 8/1998 Harwath
5,863,220 A 1/1999 Holliday
5,975,951 A 11/1999 Burris et al.
5,984,723 A 11/1999 Wild et al.
5,993,254 A 11/1999 Pitschi et al.
5,997,350 A 12/1999 Burris et al.
6,019,636 A 2/2000 Langham
6,032,358 A 3/2000 Wild et al.
6,034,325 A 3/2000 Nattel et al.
RE36,700 E 5/2000 McCarthy
6,080,015 A 6/2000 Andreescu et al.
6,089,912 A 7/2000 Tallis et al.
6,168,455 B1 1/2001 Hussaini
6,733,336 B1 5/2004 Montena et al.
6,808,415 B1 * 10/2004 Montena ..... 439/584
7,329,149 B2 * 2/2008 Montena ..... 439/584

FOREIGN PATENT DOCUMENTS

EP 0265276 4/1988
GB 1087228 10/1967
GB 1270846 4/1972
GB 2019665 10/1979
GB 2079549 1/1982

* cited by examiner

CLAMPING AND SEALING MECHANISM WITH MULTIPLE RINGS FOR CABLE CONNECTOR

CROSS REFERENCE TO RELATED APPLICATION

This application is a continuation of U.S. Ser. No. 10/972,989, filed on Oct. 25, 2004, which is a continuation in part of U.S. Ser. No. 10/764,782 filed Jan. 26, 2004, now U.S. Pat. No. 6,808,415.

FIELD OF THE INVENTION

This invention relates generally to the field of cable connectors, and more particularly to a cable connector having multiple rings which provide the required clamping and sealing function via an interference fit between a coaxial cable having either a solid or braided ground sheath and a portion of the connector body.

BACKGROUND OF THE INVENTION

Coaxial cable connectors, whether connecting coaxial cable to an equipment port or two cables to each other, rely on RF (radio frequency) shielding to prevent stray RF emanations from entering the cable system and interfering with the quality of the cable signal. It is important to ensure that the ground path is well established through the connector to thwart unwanted signals from penetrating the system. At the same time, it is important to prevent external environmental effects, such as moisture, grit or other contaminants, from entering the connector and degrading the shielding performance of the connector. There exist any number of types and styles of connectors with any number of internal parts to ensure that the shielding from stray emanations exists and to prevent outside moisture or contaminants from entering the connector. For example, U.S. Pat. No. 5,393,244 to Szegda, which is incorporated herein, discloses a hardline coaxial connector using various components of a connector body assembly to seize the outer conductor of a cable between a mandrel and a single clamping member. Similarly, U.S. Pat. No. 6,676,446 to Montena, which is also incorporated herein, discloses an F-type coaxial connector that incorporates an external compression member which when axially advanced deforms a portion of the connector body into sealed engagement with the outer protective jacket of a coaxial cable. The multiplicity of specialized parts in many of the prior art connectors adds to the complexity and cost of coaxial cable connectors. Moreover, many of the prior art connectors grip the outer conductor and/or the outer protective jacket of the coaxial cable at only a relatively short longitudinal length between the mandrel or post and the clamping member or compression member.

It is well known in the art that coaxial cable generally comprises a central conductor, which is surrounded by a dielectric material, which in turn is surrounded by an outer conductor. It is also well known in the art that certain classes of coaxial cable use different layers of material as the outer conductor. Some classes of cable use a solid generally tubular outer conductor comprised of a metal such as aluminum. Other classes of cable use layers of metal foil and/or a braided mesh of metal wire to form the outer conductor. The outer conductor may also be covered with a protective jacket of suitable plastic or rubberized material that aides in keeping moisture and dirt off the cable and out of its various connections in the network. The integrity of the signal carried on the central conductor is best maintained when the outer conductor is well grounded through coaxial cable connectors by use of mandrels, connector bodies and attachments to equipment used in a cable distribution network. Coaxial cable connectors must therefore mechanically secure to a cable, seal against the infiltration of moisture and contaminants, and electrically engage the outer conductor to shield the distribution network from the ingress of RF interference.

SUMMARY OF THE INVENTION

It is a primary object of the present invention to improve cable systems.

It is a further object of the present invention to provide a coaxial cable connector which adequately secures to a cable, seals against the infiltration of moisture and contaminants and electrically engages the outer conductor of the cable to shield against the ingress of RF interference.

A still further object of the present invention is to provide a coaxial cable connector with a plurality of rings which when axially compressed result in a relatively greater length of the cable being more uniformly gripped and sealed between the mandrel or post and the connector body or compression member.

Briefly stated, the invention includes a two-piece cable connector having a connector body and a threaded nut or axial compression fitting that attaches at a first end of the connector body. A mandrel is disposed within the connector body for receiving a prepared end of a coaxial cable. Two series of rings are interleaved adjacent each other, with the rings being fitted inside the connector body outside a portion of the mandrel. A deformable ring can be fitted adjacent any gapped rings used near the first end of the connector body. The threaded nut or compression fitting drives the rings against each other and the inboard ring against the series of rings in wedging engagement, thus creating an interference fit among the grounded connector body, the series of rings, a ground sheath of a coaxial cable, and the mandrel. Use of the deformable ring forms a seal protecting the inside of the cable connector from the environment.

According to an embodiment of the invention, a cable connector includes a connector body having a cavity therein; a mandrel fitted inside the cavity for receiving a prepared coaxial cable end at an end of the connector body; a number of inner rings are fitted between a first portion of the mandrel and the connector body and a number of outer rings are fitted between the first portion of the mandrel and the connector body, the inner rings and the outer rings capable of a wedging relationship; the inner rings and the outer rings being interleaved with one another so that adjacent surfaces of the inner rings and the outer rings are in tapered relationship with each other; at least one of the inner rings being of electrically conductive material; a first sealing ring having a wedge-shaped cross section adjacent to one of the outer rings and in tapered relationship with the one of the outer rings, the first sealing ring being closer to the end of the connector body than the inner and outer rings; a second sealing ring adjacent the first sealing ring, the second sealing ring being closer to the end of the connector body than the first sealing ring, and the second sealing ring having a surface in tapered relationship with a tapered surface of the first sealing ring; and driving means, attached to the connector body at the end of the connector body, for driving the second sealing ring into wedging engagement with the first sealing ring, thereby driving the first sealing ring to drive the inner and outer rings into wedging engagement with each other.

According to an alternative embodiment of the invention, a cable connector particularly suited for use with cable having an outer conductor at least a portion of which is braided wire includes: a connector body having a cavity therein; a mandrel fitted inside the cavity for receiving a prepared coaxial cable end at an end of the connector body; inner and outer rings fitted between a portion of the mandrel and the connector body, the inner rings and the outer rings capable of a wedging relationship and are interleaved with one another so that adjacent surfaces of the inner rings and the outer rings are in wedging or mated relationship with each other. At least one of the inner rings or the mandrel being composed of electrically conductive material so as to ground the outer conductor of the cable to a piece of equipment through the connector body. At least one of the inner rings is fully circular and composed of a deformable material and a compression member operatively engaged with and radially adjacent to the connector body at the end of the connector body, for driving the inner and outer rings into wedging engagement with each other, such that the deformable ring forms a continuous, 360 degree seal between the coaxial cable and the connector. The connector also includes a means for attaching the connector to a port or interface with a piece of equipment, such as external threads of a KS-type interface.

According to a further alternative embodiment of the invention a cable connector particularly suited for use with flexible coaxial cable having an outer conductor at least a portion of which is braided wire includes: a connector body having a cavity therein; an electrically conductive mandrel or post fitted inside the cavity for receiving a prepared coaxial cable end at an end of the connector body; inner and outer rings are fitted between a portion of the mandrel and the connector body, and are capable of a wedging relationship. The inner rings and the outer rings being interleaved with one another so that adjacent surfaces of the inner rings and the outer rings are in wedging or mated relationship with each other. At least one of the rings is fully circular and composed of a deformable material and a driving means is included which comprises a compression member, operatively engaged with and radially adjacent to the connector body at the end of the connector body, for driving the inner and outer rings into wedging engagement with each other, such that the deformable ring forms a continuous 360 degree seal between the coaxial cable and the connector. The connector also includes a means for attaching the connector to a port or interface with a piece of equipment, such as an industry standard F-type hexagonal nut.

According to the alternative embodiments of the invention, a method for installing a cable connector includes the steps of (a) providing a connector body having a cavity therein; (b) providing a mandrel fitted inside the cavity for receiving a prepared coaxial cable end at an end of the connector body; (c) providing a number of inner rings fitted between a first portion of the mandrel and the connector body and a number of outer rings fitted between the first portion of the mandrel and the connector body, wherein the inner rings and the outer rings are capable of a wedging relationship, (d) interleaving the inner rings and the outer rings with one another so that adjacent surfaces of the inner rings and the outer rings are in wedging or mated relationship with each other; and (e) driving the inner and outer rings into wedging engagement with each other.

DETAILED DESCRIPTION OF THE PREFERRED EMBODIMENT

Figure 1:
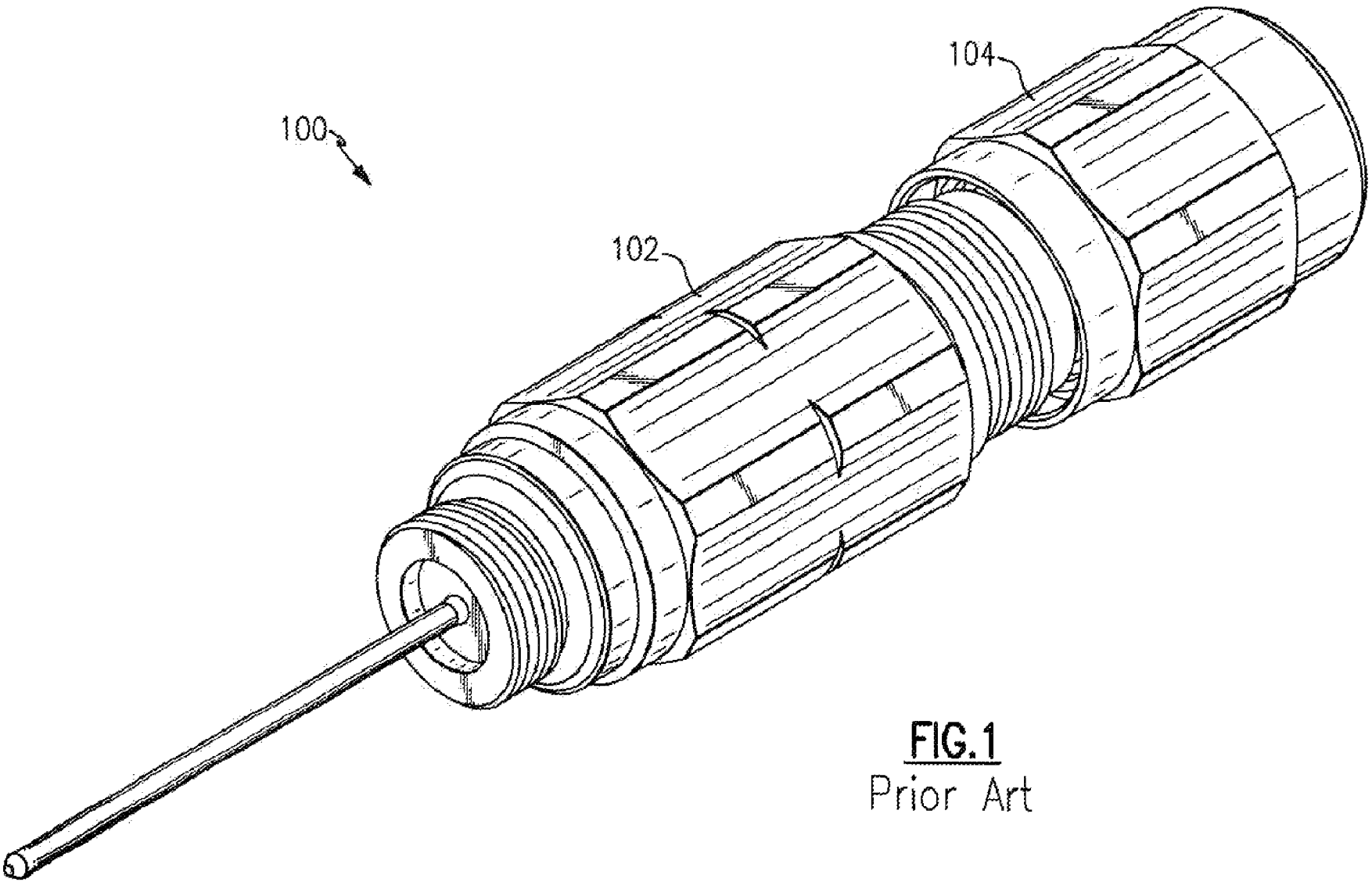
FIG.1 Prior Art
FIG. 1 shows a perspective view of a typical two-piece pin connector according to the prior art.
Figure 2:
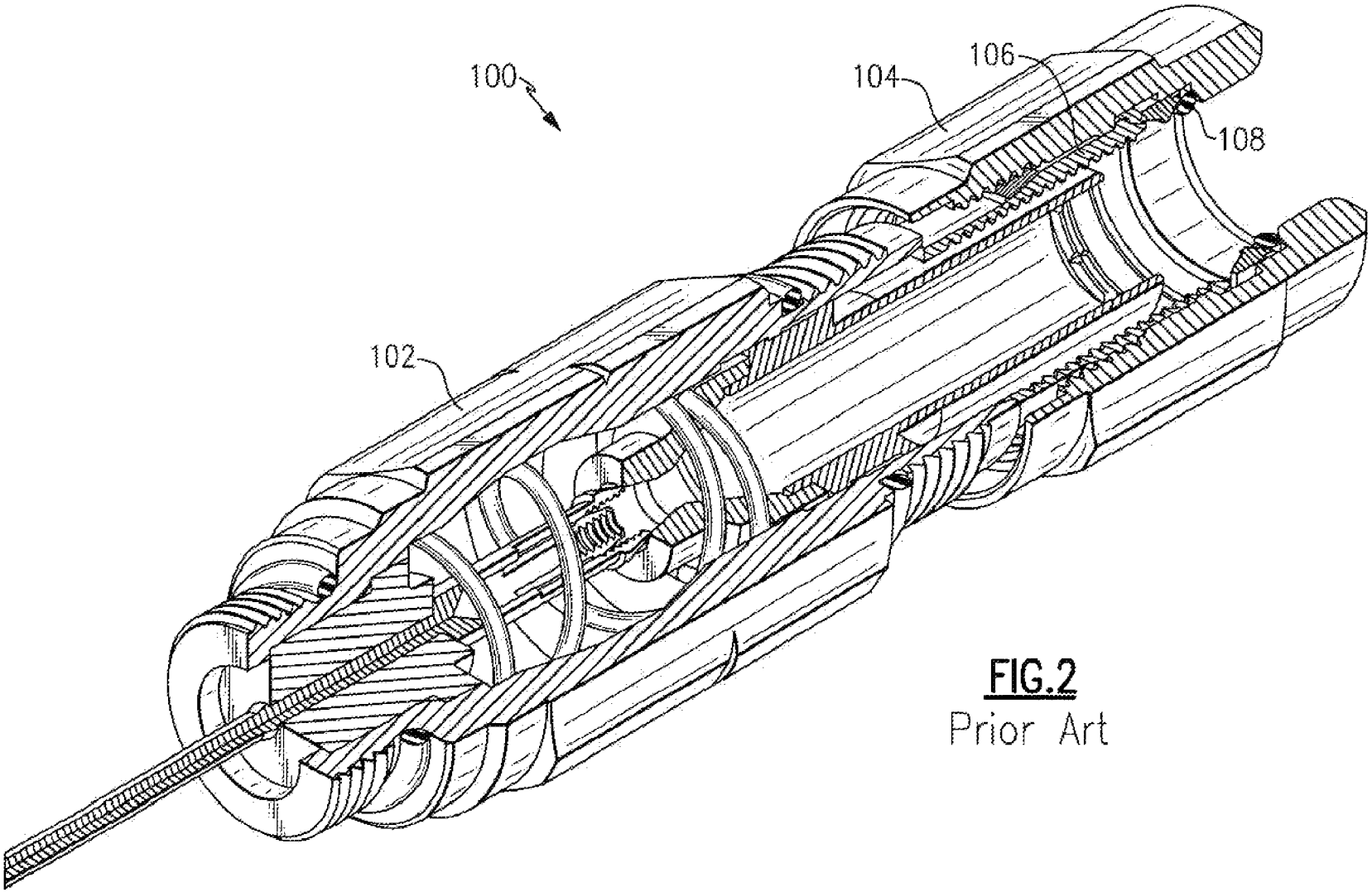
FIG.2 Prior Art
FIG. 2 shows a cutaway perspective view of the prior art connector of FIG. 1.
Figure 3:
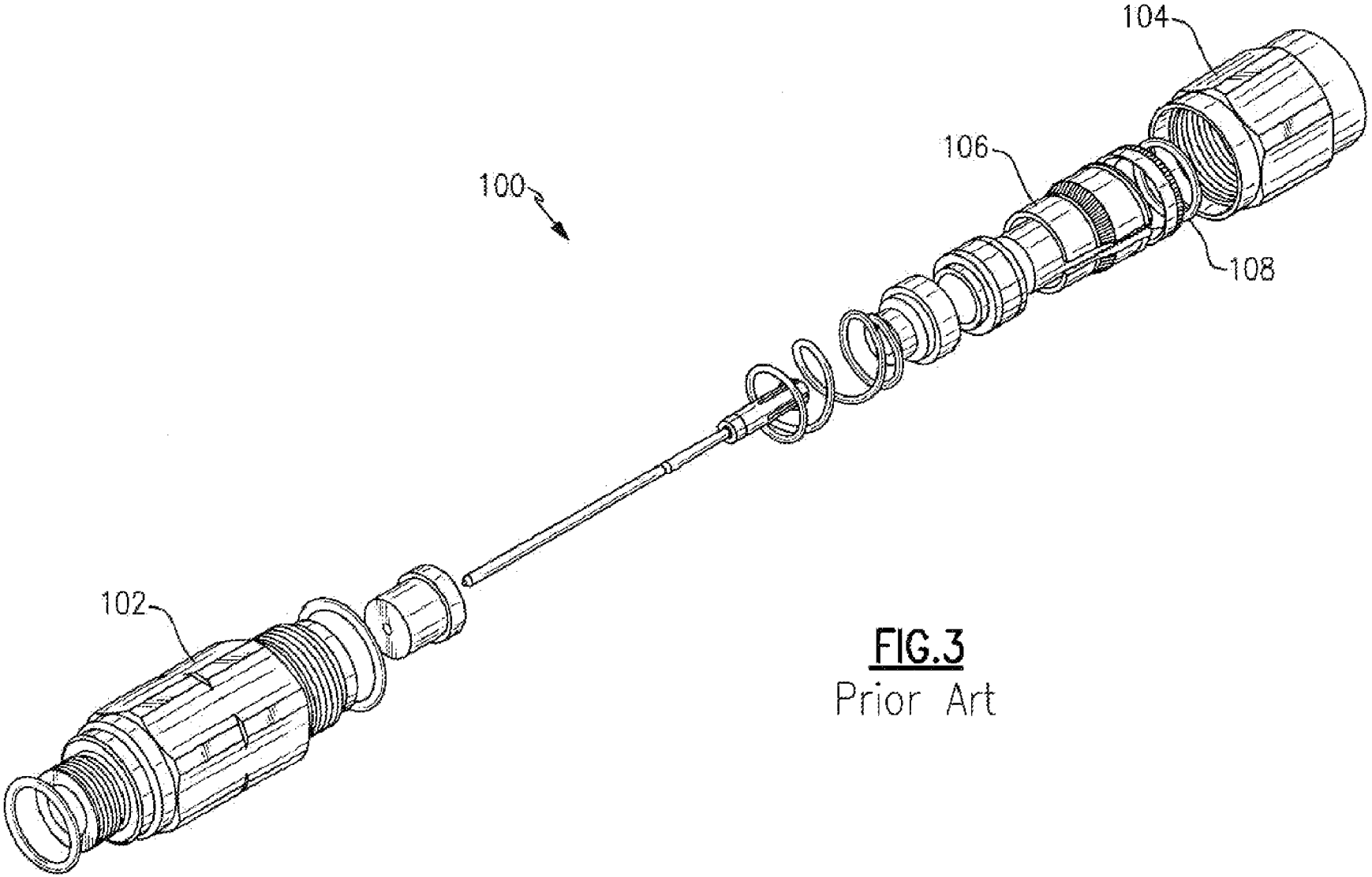
FIG.3 Prior Art
FIG. 3 shows an exploded perspective view of the prior art connector of FIG. 1.

Referring to FIGS. 1-3, a prior art two-piece cable connector 100 includes a nut 104 fastened onto a connector body 102. A clamp 106 is pressed against a prepared cable ground sheath (not shown) of a coaxial cable (not shown) as nut 104 is tightened onto connector body 102. An O-ring 108 seals against an outer coating (not shown) of the coaxial cable to prevent moisture or contaminants from affecting the cable connection with cable connector 100. It is evident in FIG. 3 that the component pieces of cable connector 100, although not numerous, have to be specially made in the right configurations of the proper materials in order to have cable connector 100 work properly.

Figure 4:
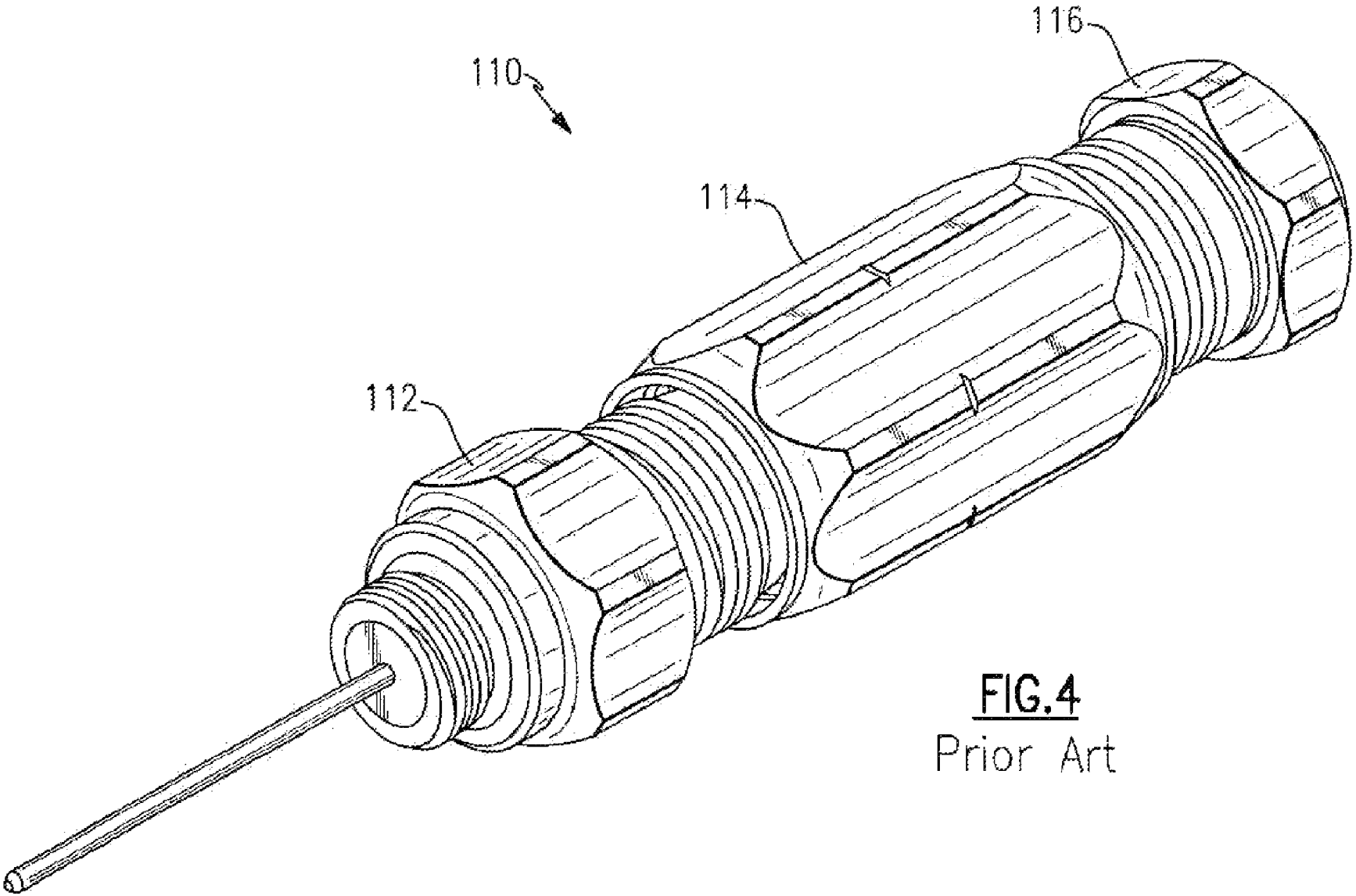
FIG.4 Prior Art
FIG. 4 shows a perspective view of a typical three-piece connector according to the prior art.
Figure 5:
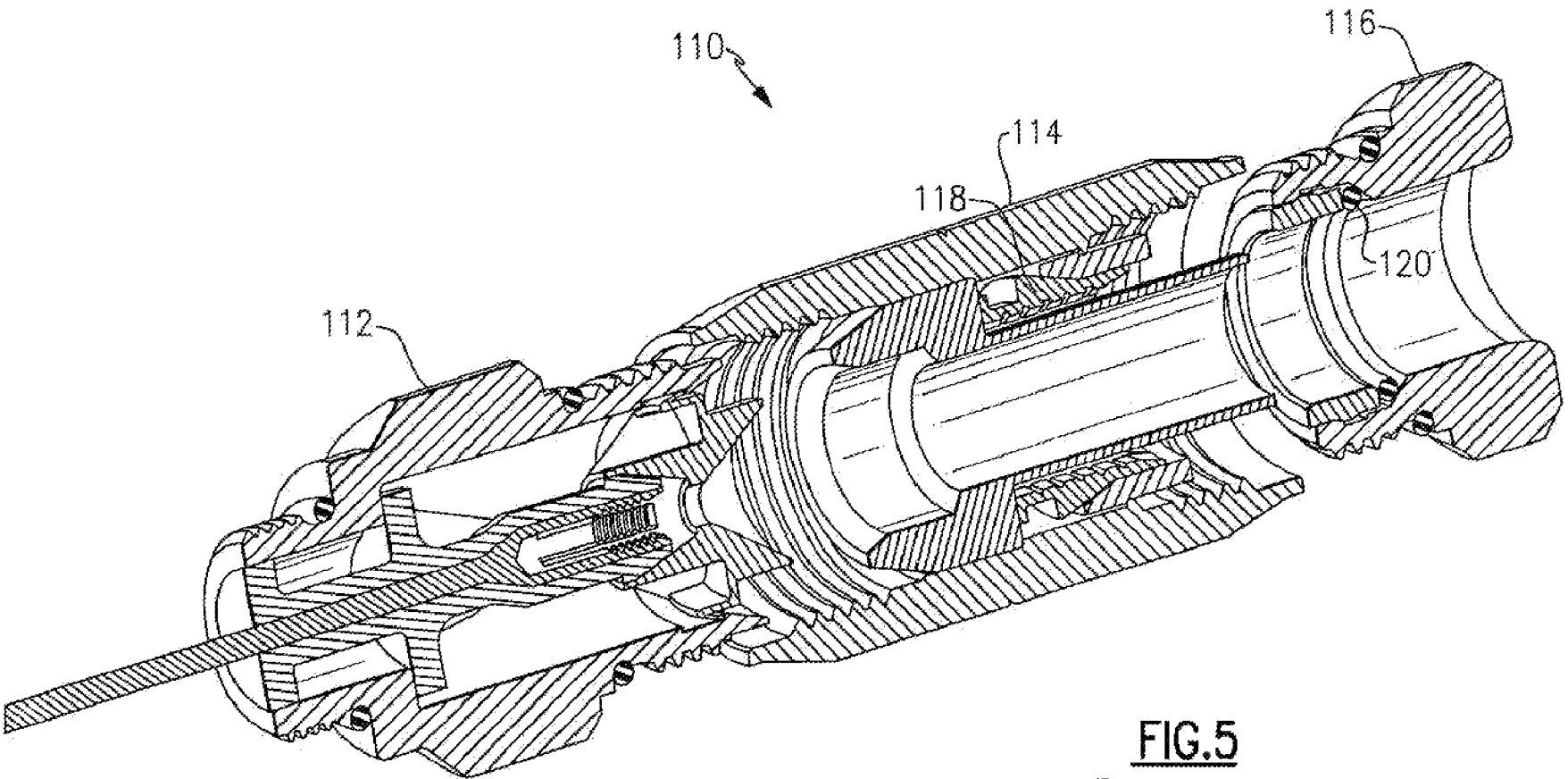
FIG.5 Prior Art
FIG. 5 shows a cutaway perspective view of the prior art connector of FIG. 4.
Figure 6:
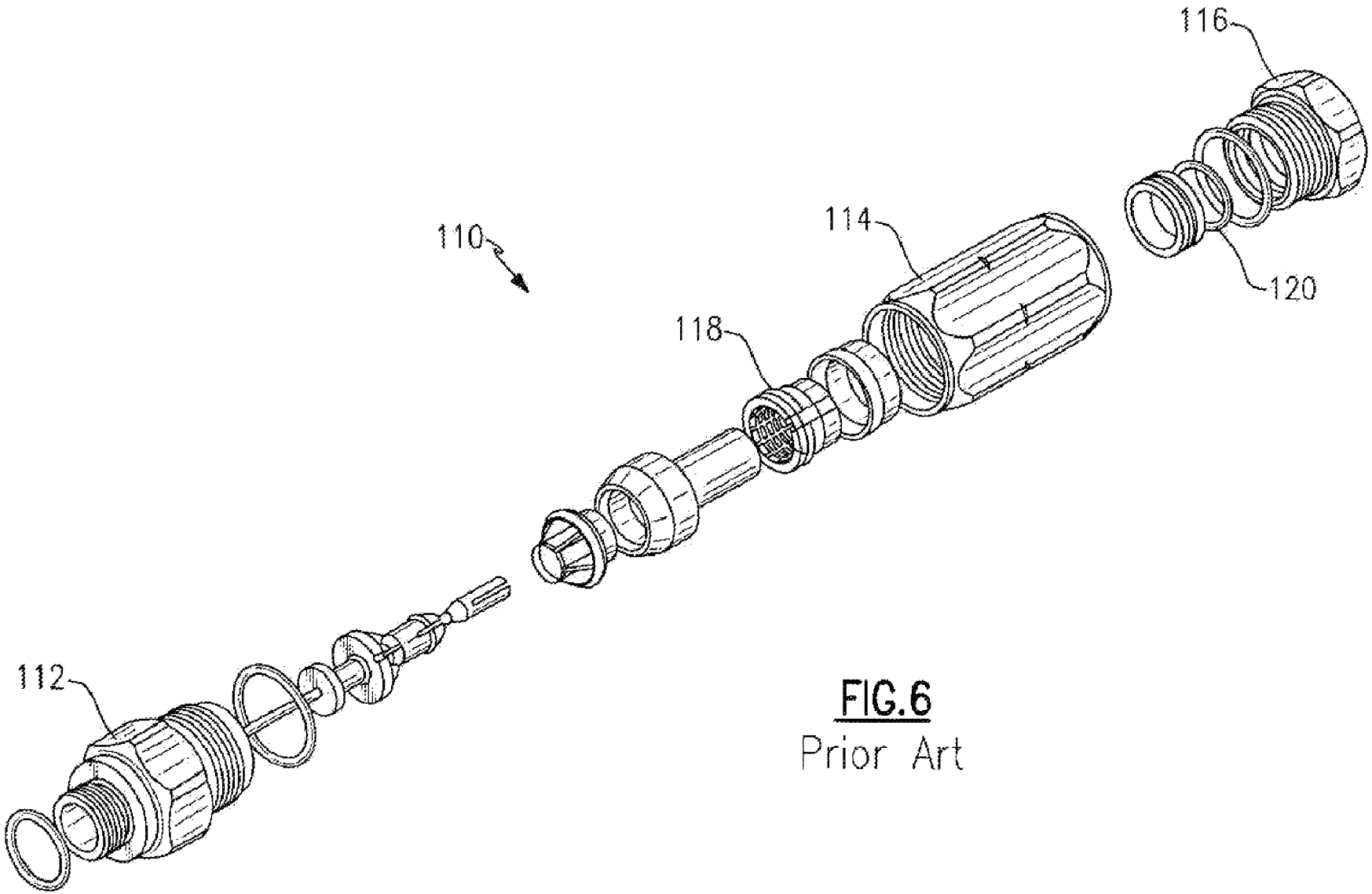
FIG.6 Prior Art
FIG. 6 shows an exploded perspective view of the prior art connector of FIG. 4.

Referring to FIGS. 4-6, a prior art three-piece connector 110 includes a front body 112, a back body 114 screwed onto front body 112, and a nut 116 screwed onto back body 114. A clamp 118 presses against the prepared cable ground sheath when nut 116 is tightened onto back body 114, while an O-ring 120 performs the necessary sealing function. It is clear from FIG. 6 that the individual pieces that are required to be made of a conducting material, such as metal, have to be precisely machined.

Figure 7:
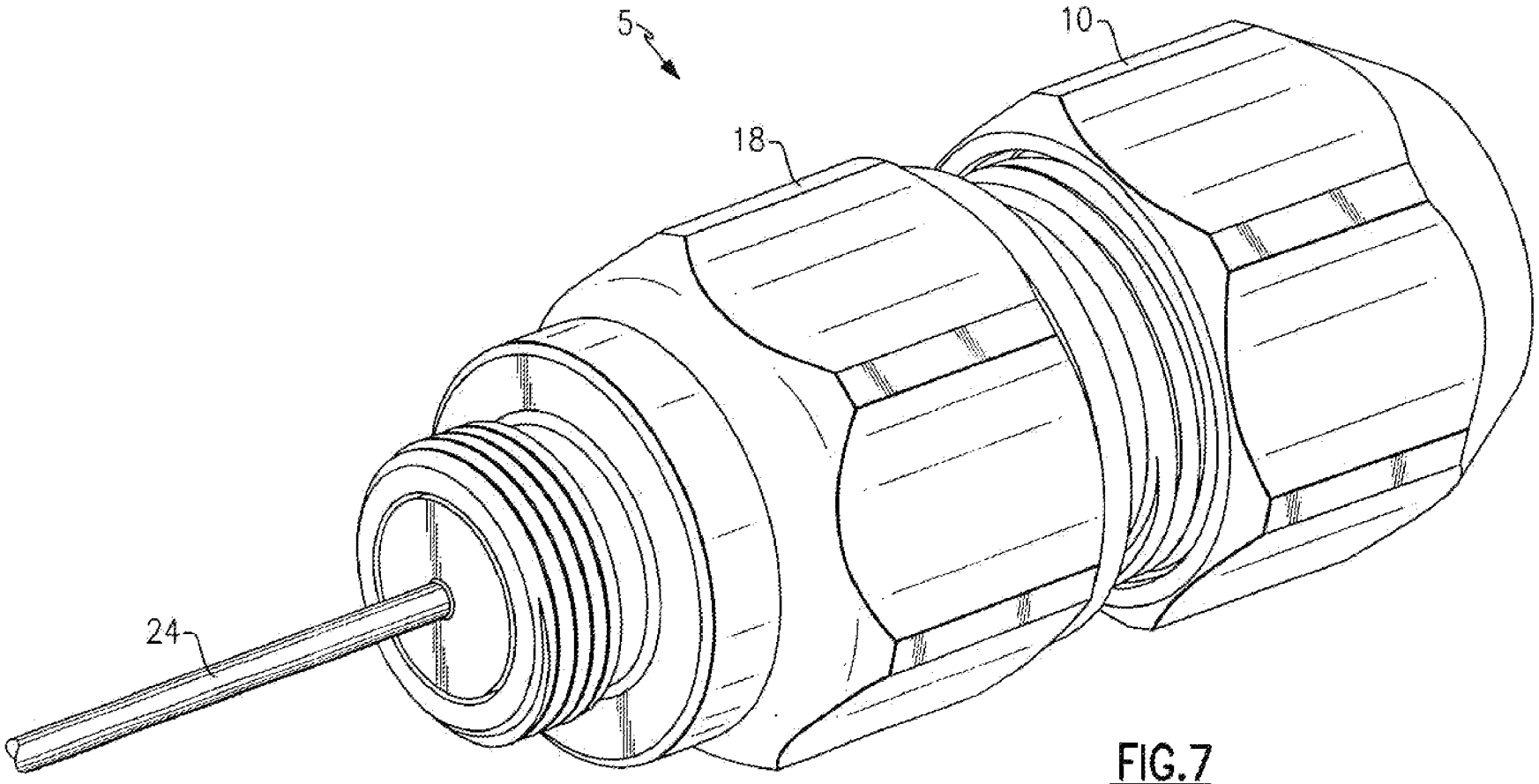
FIG. 7 shows a perspective view of a two-piece connector according to an embodiment of the invention.
Figure 8:
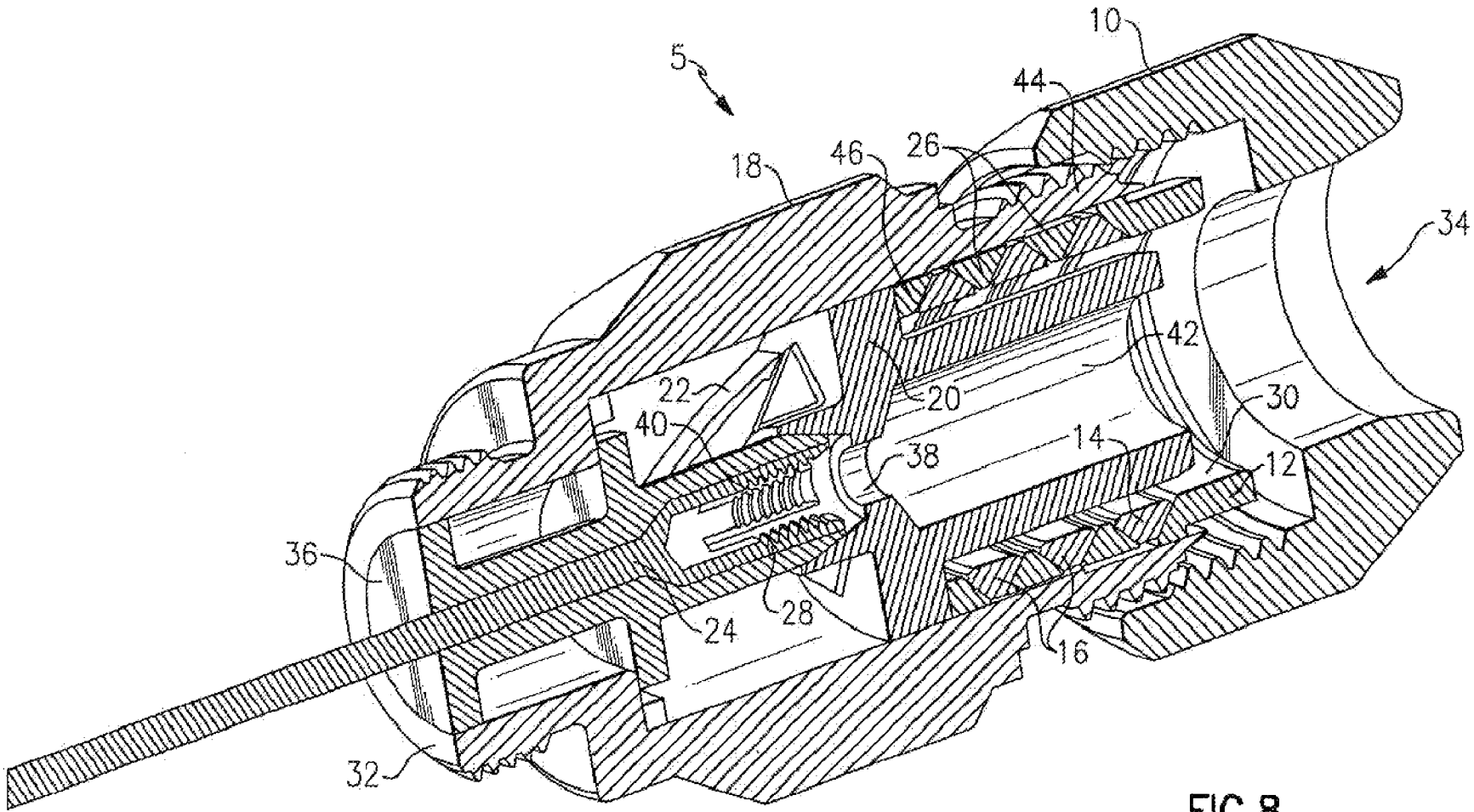
FIG. 8 shows a cutaway perspective view of the embodiment of FIG. 7.
Figure 9:
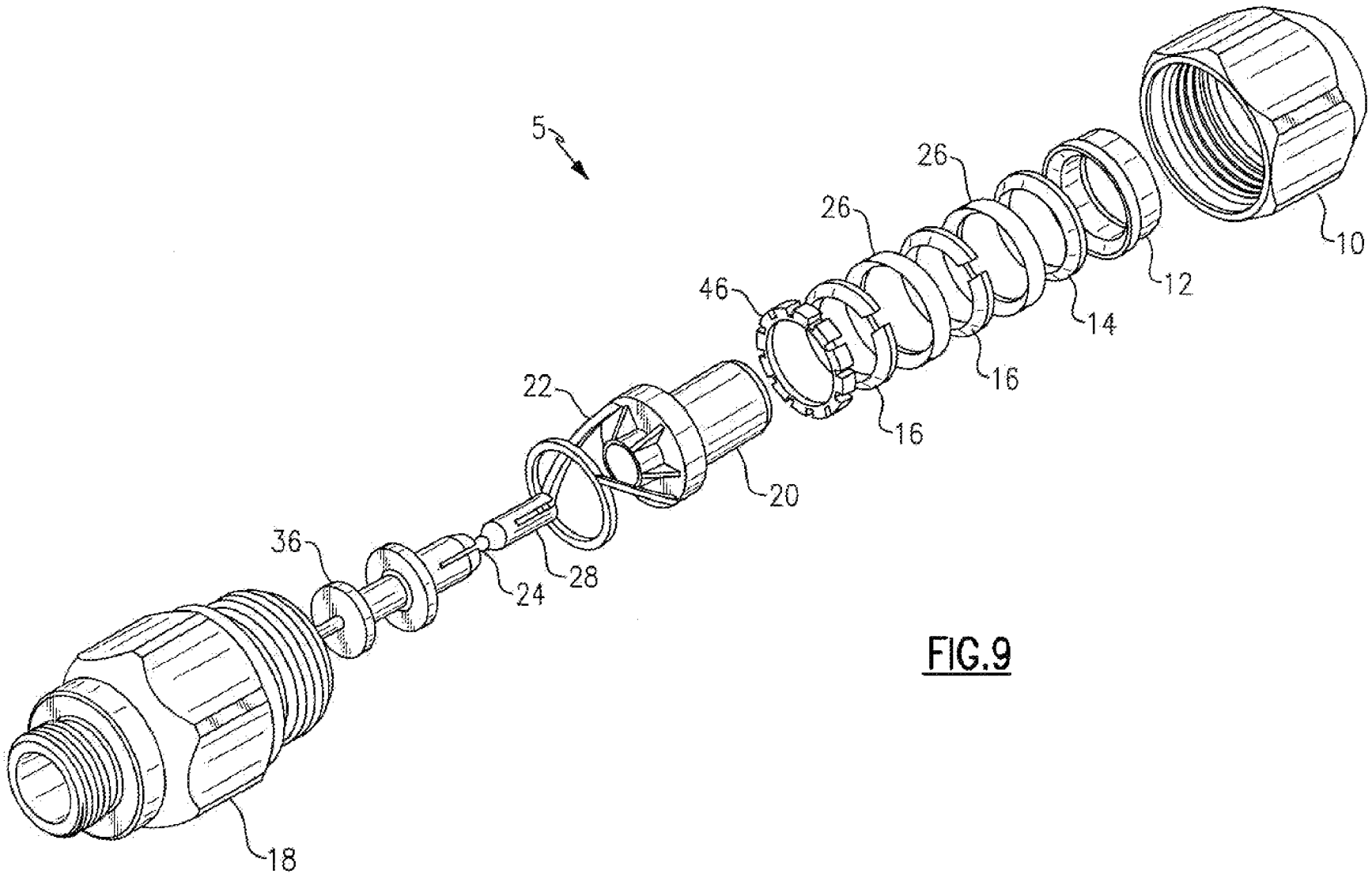
FIG. 9 shows an exploded perspective view of the embodiment of FIG. 7.

Referring to FIGS. 7-9, a cable connector 5 according to an embodiment of the invention is shown. A connector body 18 provides a housing for an end of the cable (not shown) which is connected to an equipment port (not shown) via a grounded end 32 and a conductive pin 24. Conductive pin 24 is electrically connected to a center conductor (not shown) of the cable while end 32 of body 18 is electrically connected to the ground sheath (not shown) of the cable, as is explained below. The invention is not dependent on the particular type of cable connector shown here, but is applicable to any connection between a cable and a cable connector.

Conductive pin 24 is held in place in body 18 by an insulator 36, which also prevents conductive pin 24 from making electrical contact with body 18. Body 18 has to be electrically conductive because it constitutes part of the ground path from the cable ground sheath to end 32 which is connectable to the grounding circuit of the equipment port. The cable end is prepared for connection to connector 5 by stripping part of a dielectric layer (not shown) away from the center conductor of the cable, and by stripping away part of an insulating layer (not shown) covering the ground sheath when the cable includes an insulating layer.

The prepared cable end is inserted into connector 5 through a nut 10 and then an end 34 of body 18 so that the center conductor is guided by a portion 38 of a mandrel 20 into a collet 28. Collet 28 preferably includes threads 40 to provide an interference fit with the cable center conductor. The dielectric layer of the cable fits inside a main cavity 42 of mandrel 20, while the ground sheath of the cable fits between a surface portion 30 of mandrel 20 and a plurality of rings made up of inner rings 16 and outer rings 26. Inner rings 16 preferably provide electrical continuity and grip the cable ground sheath when nut 10 is tightened, while the tapered surfaces of outer rings 26 guide inner rings 16 into position when nut 10 is tightened. A deformable segmented ring 46 is preferably between a shoulder of mandrel 20 and the forwardmost inner ring 16. Surface portion 30 of mandrel 20 is preferably scored to enhance the interference fit between mandrel 20 and the ground sheath of the cable.

An inner ring 14 and an outer ring 12 are preferably of plastic. Inner ring 14 grips the cable ground sheath when nut 10 is tightened, while inner ring 14 and outer ring 12 provide the sealing function provided by O-ring 108 (FIGS. 1-3) and O-ring 120 (FIGS. 4-6) in the prior art. Note that inner ring 14 and inner rings 16 are adjacent at least one outer ring 26. Cross-sections of rings 14, 16, 26, and 46 are all wedge shaped, i.e., shaped substantially as trapezoids, with adjacent rings touching each other via tapered sides. Outer ring 12 is preferably adjacent inner ring 14. A flat portion of outer rings 26 and outer ring 12 is adjacent and touching body 18, while a flat portion of inner ring 14 and inner rings 16 is adjacent and touching the ground sheath of the cable.

Rings 46, 16, and 26 are preferably of a conducting material with metal being the preferred material, but not all of rings 16 and 26 have to be electrically conductive as long as ring 46 and the forwardmost ring 16 are electrically conductive to provide the electrical ground path from the cable ground sheath to connector body 18.

Inner rings 16 are preferably gapped rings, i.e., a portion is missing in the angular direction of the ring, so that the gap permits the inner diameter of the rings to contract when a force is applied to the outside diameter of the rings. Rings 12 and 14 are preferably complete rings and made of plastic, but when conventional O-ring sealing is used instead, as in the prior art, rings 12 and 14 can be of metal instead of plastic, i.e., metal rings 12 and 14 in conjunction with an O-ring will also perform the sealing function required.

When nut 10 is screwed onto body 18, a portion 44 of body 18 is compressed inwards by nut 10, which in turn presses against the outer diameter of rings 14, 16, and 26. In addition, nut 10 drives ring 12 into a wedging engagement with rings 14, 16, and 26. Outer ring 12, which can be of metal but is preferably of plastic in this embodiment, first engages ring 14, also preferably of plastic in this embodiment, so that ring 14 compresses forward and radially to establish a moisture seal and mechanical seal on the ground sheath of the cable, thereby replacing the sealing O-rings common in the prior art.

Ring 14 in turn applies pressure on the series of rings 16 and 26, which provide an interference fit with each other, portion 44 of body 18, and the ground cable sheath, as well as an interference fit between the ground cable sheath and surface 30 of mandrel 20. Because metal rings 16 and 26 provide good electrical contact in several narrow, high pressure bands, as well as providing a good mechanical grip, they thus replace both the sheath clamp and the RF clamp common in the prior art. When ring 12 is of plastic, ring 12 also acts as a thrust bearing between rotating nut 10 and rings 16, 26 which should not rotate in order to avoid twisting of the cable during installation. Although this embodiment is described using a nut to provide the compressive force to ring 12, a compression fitting could be used instead, such as is disclosed in U.S. patent application Ser. No. 10/686,204 filed on Oct. 15, 2003 and entitled APPARATUS FOR MAKING PERMANENT HARDLINE CONNECTION, incorporated herein by reference. The disadvantage to a compression fitting is that once the connector is connected to the cable, it is not easily disconnected without damaging the cable end.

In this embodiment, with inner rings 16 and outer rings 26 being of a conducting material such as metal to provide part of the ground circuit path between the ground sheath of the cable and body 18, mandrel 20 can be of a non-conducting material such as plastic because mandrel 20 is not needed to establish any part of the ground circuit between the cable ground sheath and body 18. A plastic mandrel 20 can thus be designed to simply reinforce mechanically the ground sheath to keep it from collapsing due to the compression action of rings 16, 26. High performance thermoplastics provide the necessary strength to serve the mechanical reinforcement function.

Using a plastic mandrel 20 also eliminates possible electrical shorting between the center conductor and the ground circuit. Using a plastic mandrel 20 also permits the use of a plurality of spring leafs 22 preferably made one-piece with mandrel 20 to help exert opening forces to disengage mandrel 20 from collet 28 when disassembling connector 5. The use of plastic spring leafs 22 does away with using a metal coil for the purpose as is known in the prior art, which eliminates the complicating effects of the metal coil on the RF signal transmission capability of the connector. Portion 38 of mandrel 20 is part of the seizure bushing known in the prior art, which in this embodiment can be made one-piece with mandrel 20. This embodiment of connector 5 also eliminates the risk of arcing when installing the connector on a "live" cable, because at no point along the connector is it possible to touch the center conductor of the cable to a conductive grounded surface inside the connector.

Figure 10:
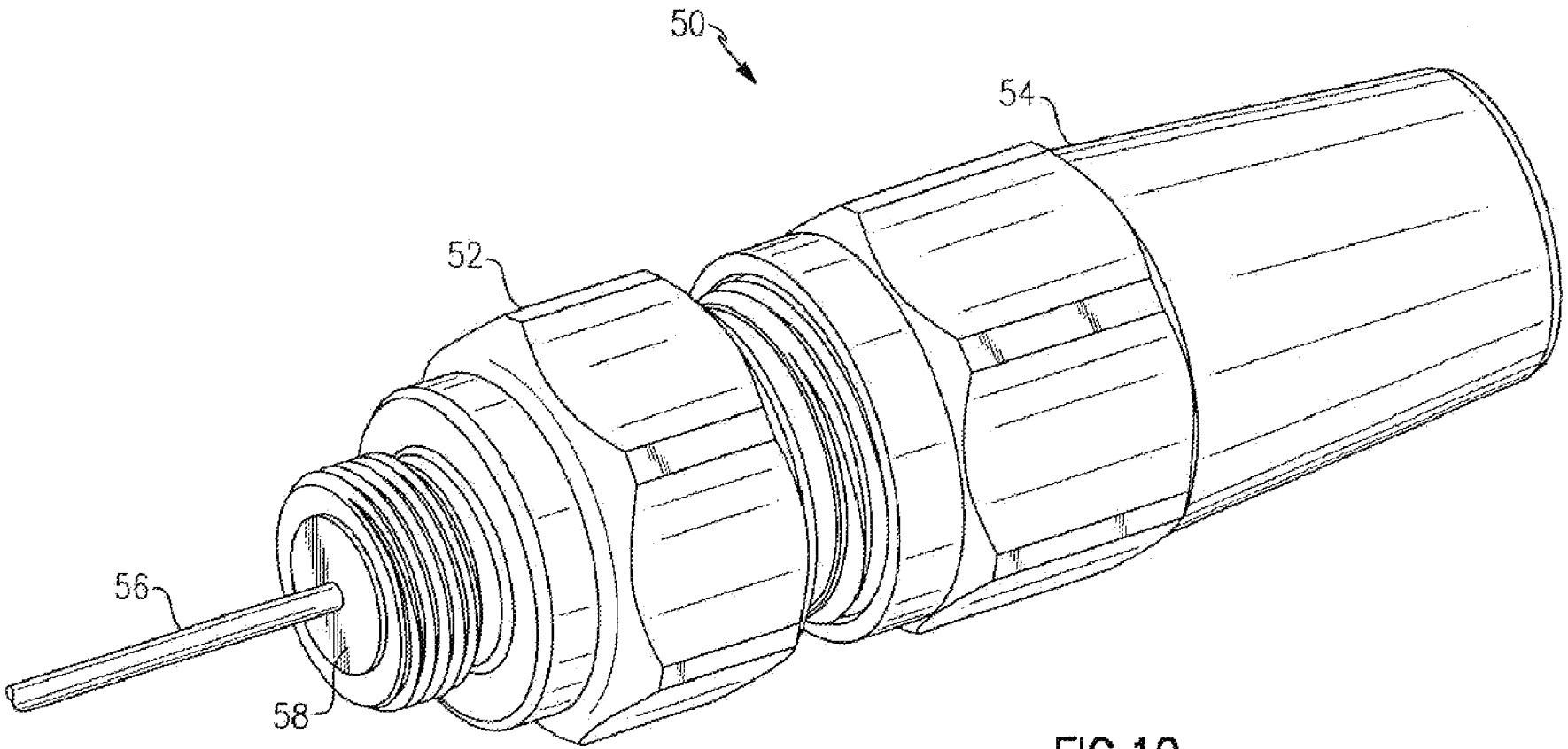
FIG. 10 shows a perspective view of a two-piece connector according to an embodiment of the invention.
Figure 11:
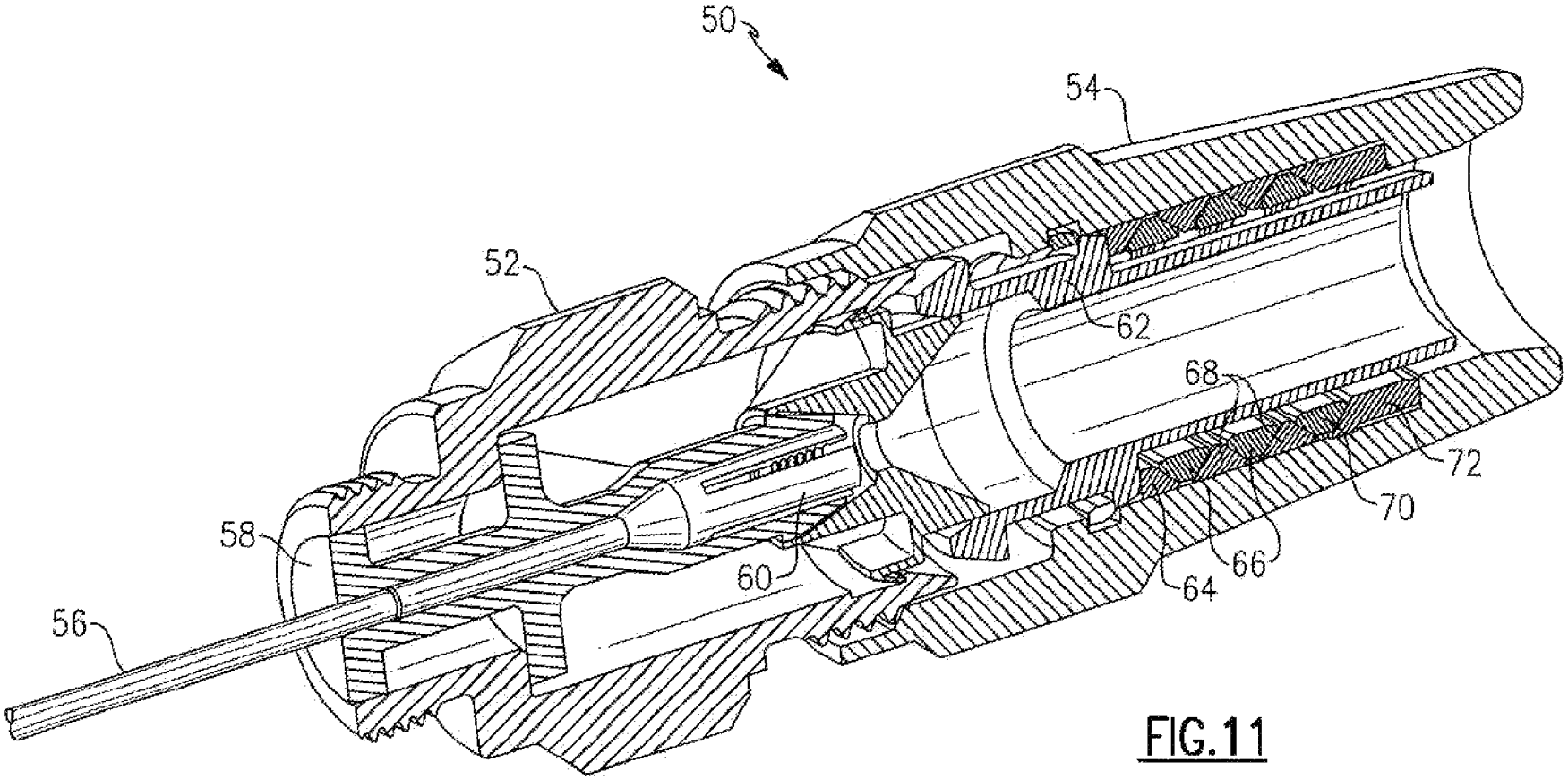
FIG. 11 shows a cutaway perspective view of the embodiment of FIG. 10.
Figure 12:
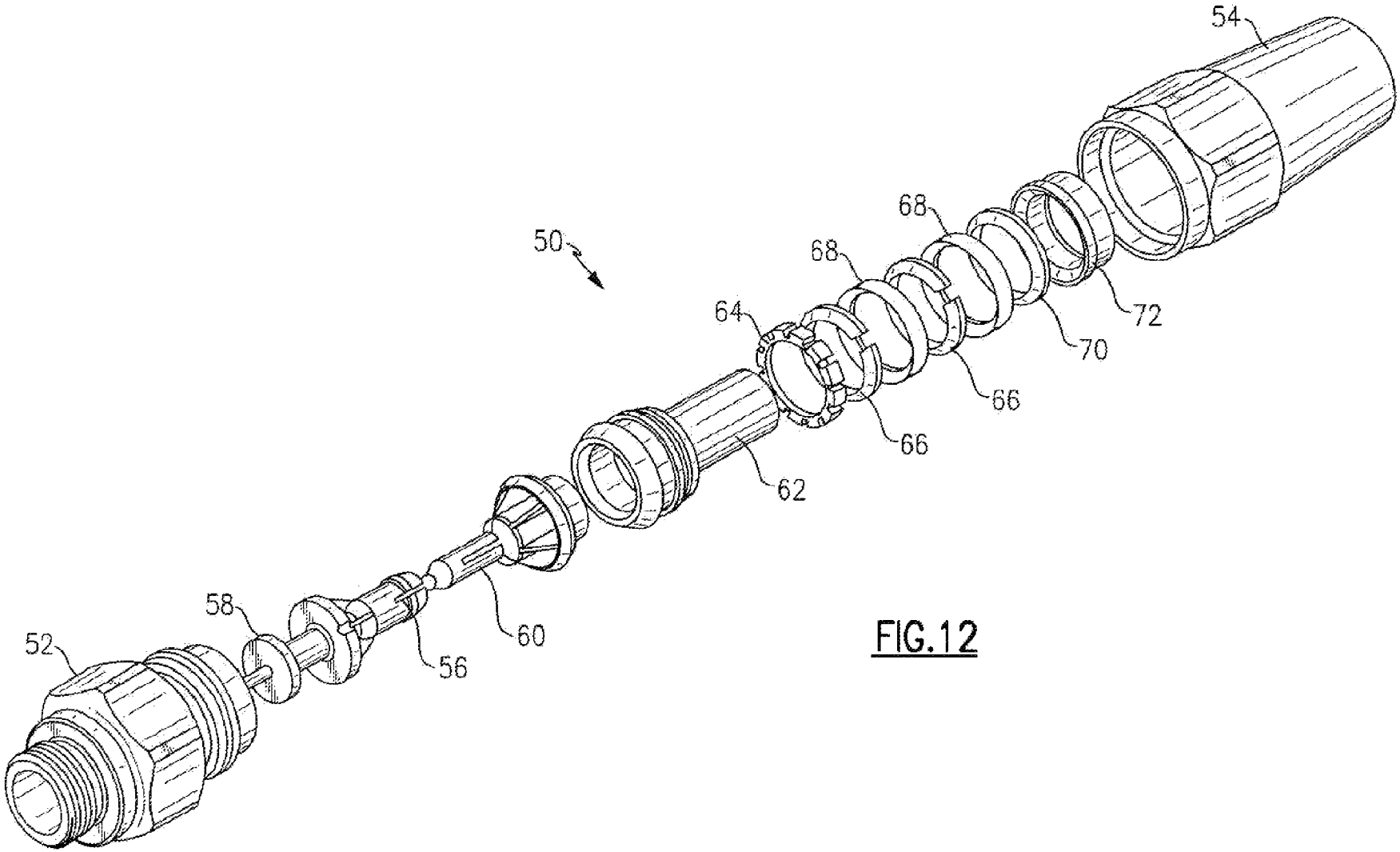
FIG. 12 shows an exploded perspective view of the embodiment of FIG. 10.

Referring to FIGS. 10-12, an alternate two-piece embodiment of the invention is shown. A cable connector 50 includes a connector body 52 with a nut 54 which screws onto connector body 52. A conductive pin which is to make electrical contact with the center conductor of the prepared cable is held in place by an insulator 58. A collet 60 seizes the center conductor of the cable when the cable end is attached to cable connector 50. A mandrel 62 helps to guide the prepared cable end during installation as well as forcing the ground sheath of the cable to be separated from the dielectric layer of the cable. The ground sheath is captured between mandrel 62 and a plurality of inner rings 66. Outer rings 64 and 68 are similar to outer rings 46 and 26 of the embodiment of FIGS. 7-9, while inner rings 66 are similar to inner rings 16 of the embodiment of FIGS. 7-9. Inner ring 70 performs a similar function as inner ring 14, while outer ring 72 performs a similar function as outer ring 12. The difference between this embodiment and the embodiment of FIGS. 7-9 is the fashion in which nut 54 connects with mandrel 62, and this alternate embodiment is presented to show how the multiple clamping and sealing rings of the present invention can be adapted to different connector body coupler configurations.

Figure 13:
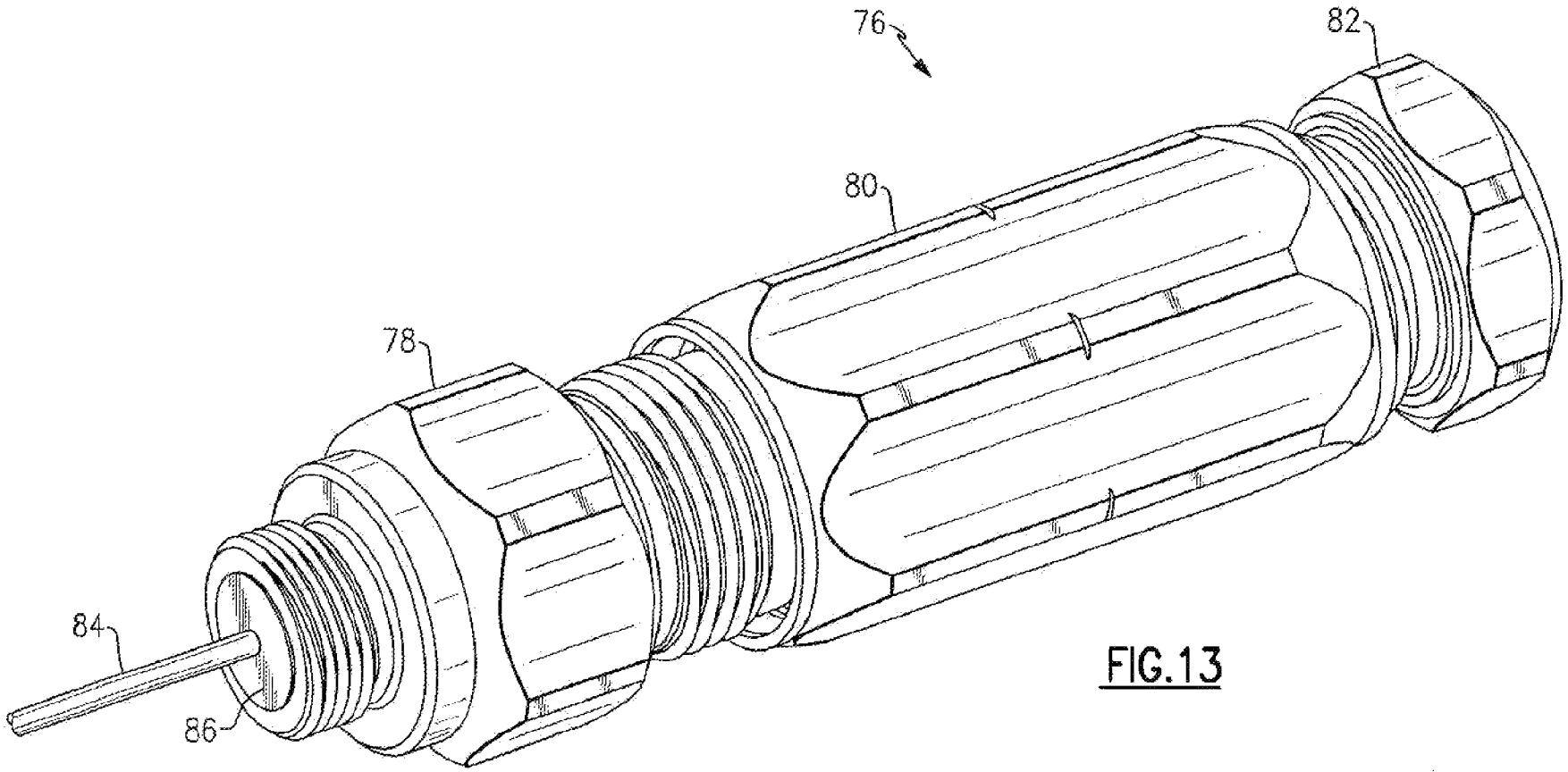
FIG. 13 shows a perspective view of a three-piece connector according to an embodiment of the invention.
Figure 14:
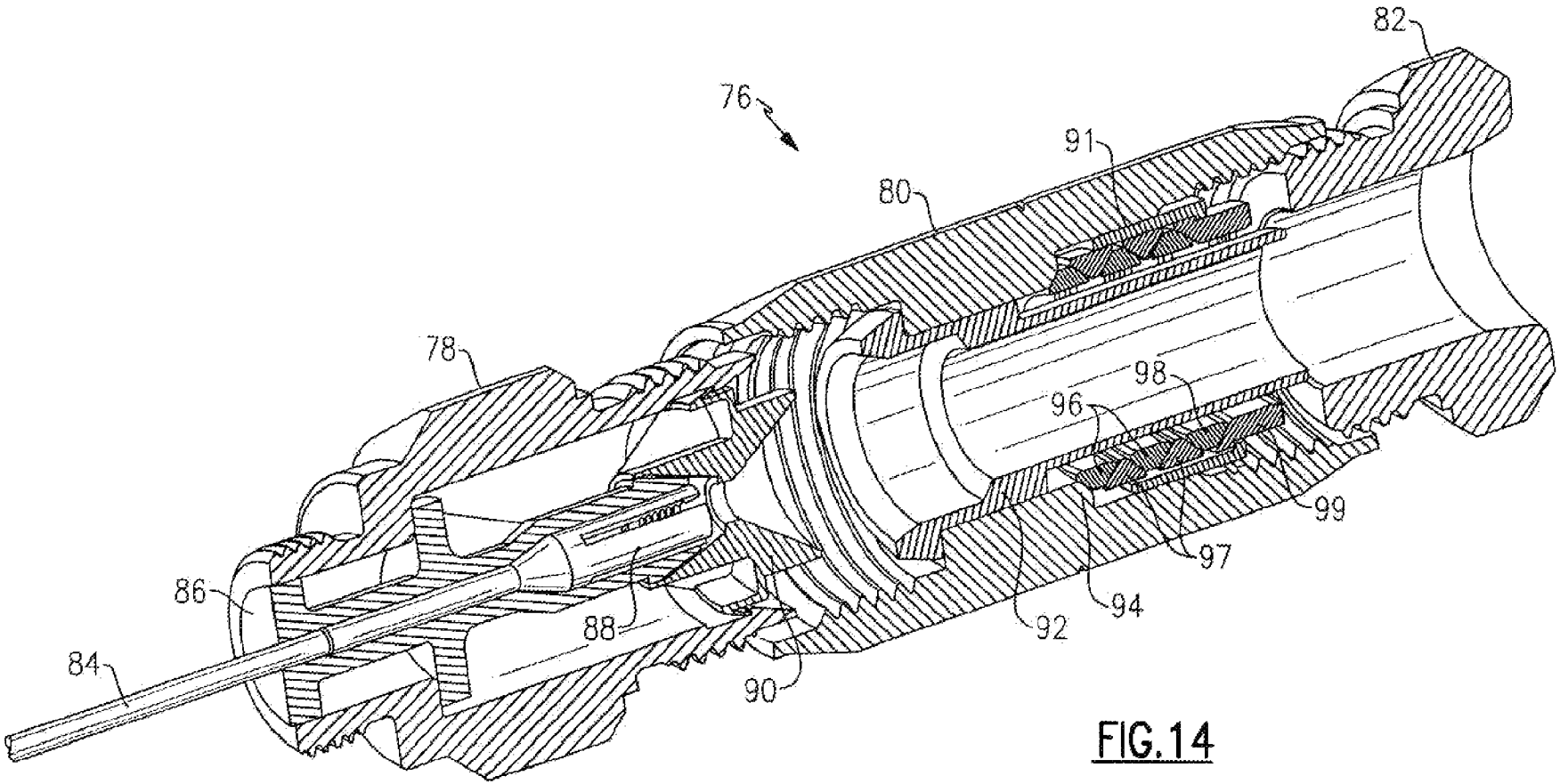
FIG. 14 shows a cutaway perspective view of the embodiment of FIG. 13.
Figure 15:
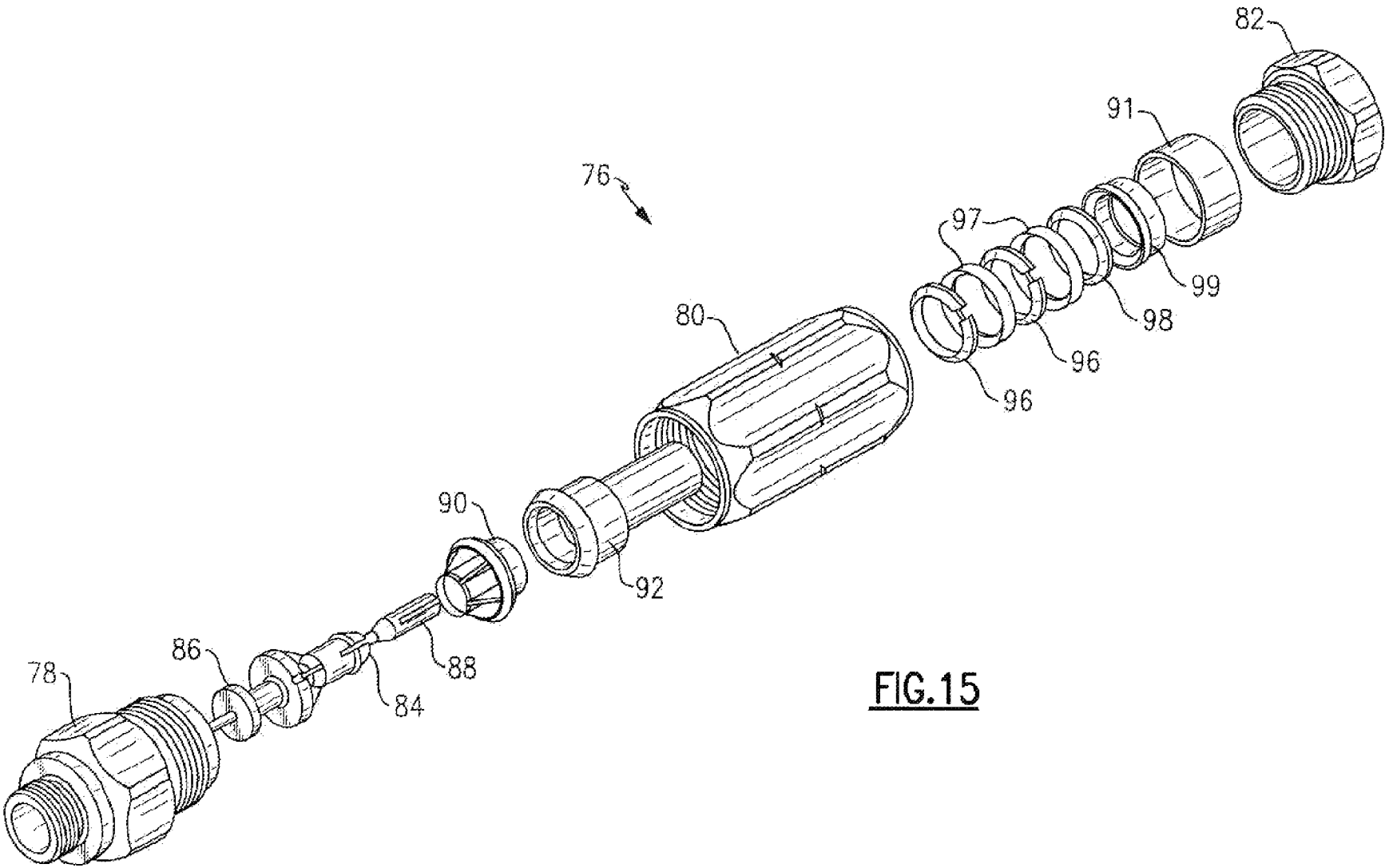
FIG. 15 shows an exploded perspective view of the embodiment of FIG. 13.

Referring to FIGS. 13-15, a three-piece pin connector is shown in which a cable connector 76 includes a front body 78, a back body 80, and a nut 82. The purpose of the three-piece pin connector is to allow fastening front body 78 to an equipment port before connecting the cable to back body 80 and screwing the combination of the cable and back body 80 to front body 78. Screwing nut 82 forces the clamping and sealing mechanism of the invention against both back body 80 and the prepared cable end. As in the above embodiments, a conductive pin 84 is held in place by an insulator 86. A collet 88 at one end of conductive pin 84 receives the center conductor of the cable as it is guided by a bushing/guide 90. A mandrel 92 receives the dielectric layer of the cable end on its inside, with the conductive ground sheath positioned between mandrel 92 and the clamping and sealing mechanism of the present invention, which includes inner rings 96, inner ring 98, outer rings 97, and outer ring 99. A thrust bearing 91 ensures that the cable is not twisted as back body 80 is screwed onto front body 78. Note that unlike the previous embodiments, the ring corresponding to ring 46 in the embodiment of FIGS. 7-9 and to ring 64 in the embodiment of FIGS. 10-12 is replaced functionally by a beveled shoulder 94 which is part of back body 80. When nut 82 is screwed onto back body 80, the multi-ring clamping and sealing mechanism functions as previously described in the other embodiments.

Figure 16:
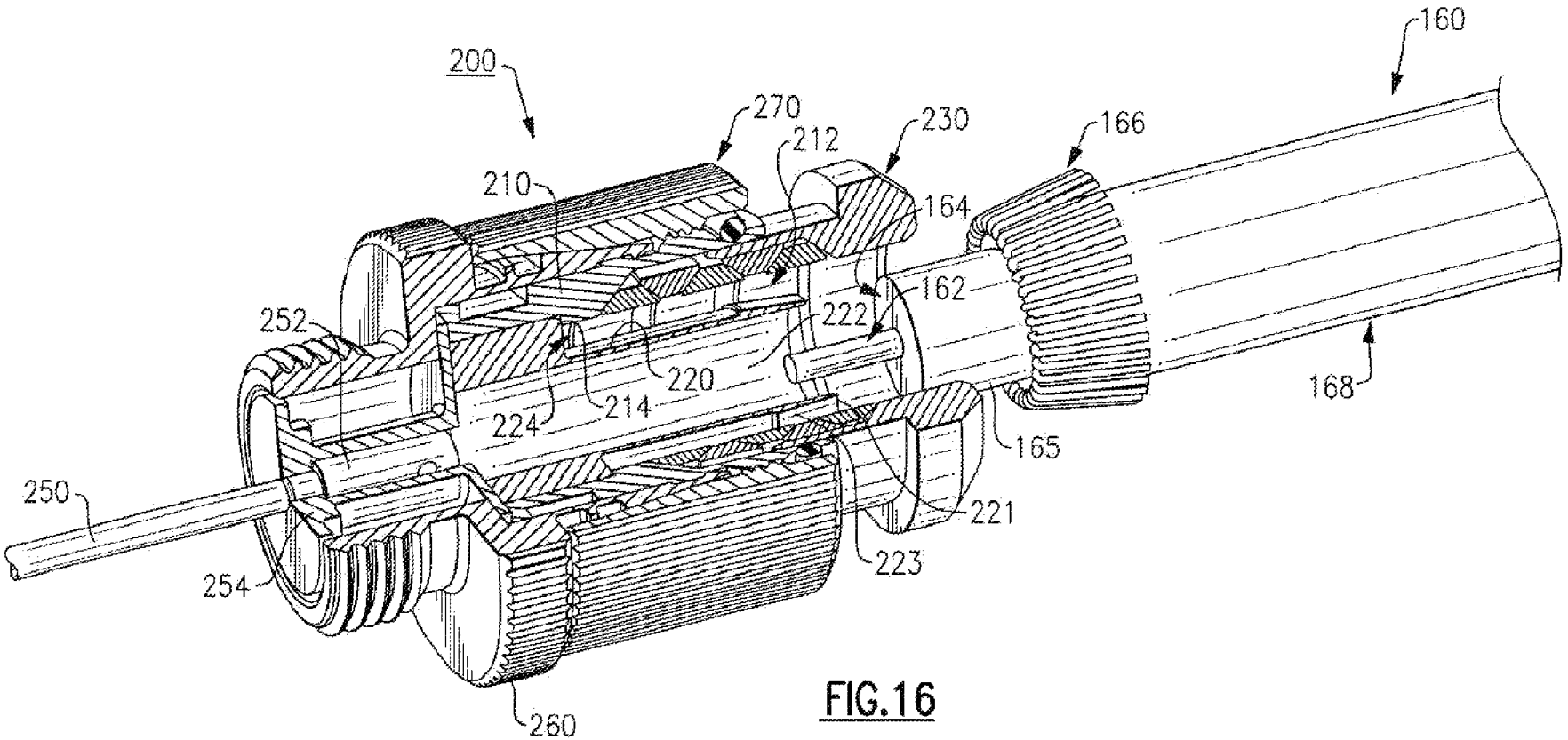
FIG. 16 shows a partial cutaway perspective view of the alternative embodiment of the invention and a prepared end of a coaxial cable.

Referring to FIGS. 16-19, an alternative embodiment of the invention is shown. A coaxial connector 200 is depicted which is particularly, though not exclusively, suited for use with a coaxial cable 160 having at least a portion of the outer conductor comprised of wire mesh or braid 166. Referring to FIG. 16, the connector 200 includes a connector body 210, a mandrel 220 and a compression member 230. The connector body 210 is generally tubular in shape and defines an inner cavity 212. In connectors for cables using a wire mesh 166 as at least a portion of the outer conductor, the mandrel 220, which is often referred to in the art as a post, is typically composed of electrically conductive material. The inner surface of the connector body may also include a first shoulder 214 for receiving and retaining by way of a press or interference fit a complementary shoulder 224 of the mandrel. Alternatively, the connector body and the mandrel may be formed in a single piece of electrically conductive material. A first end 221 of the mandrel is generally tubular in shape and also defines a cavity 222 within the mandrel for receiving at least the center conductor 162 and dielectric layer 164 of the coaxial cable. For those cables which also include one or more layers of conductive foil 165 wrapped around the dielectric layer, the foil is also typically inserted into the cavity 222 at the end of the mandrel 220 and assists in electrically engaging the outer conductor with the mandrel. The first end 221 of the mandrel is typically inserted beneath the wire mesh 166 to better electrically engage the outer conductor. The first end 221 of the mandrel may also include a single barb 223 as shown or, alternatively, one or more serrations for improving retention of the first end of the mandrel 221 between the dielectric layer 164 and the wire mesh 166. In preparing the coaxial cable for insertion into the connector, the wire mesh 166 is typically folded back over the protective jacket 168 of the cable as depicted in FIG. 16. Folding the wire mesh 166 back over the jacket 168 allows for easier insertion of the first end 221 of the mandrel 220 beneath the wire mesh and assists in electrically engaging the outer conductor with the conductive elements of the connector such as the connector body 210.

Figure 20:
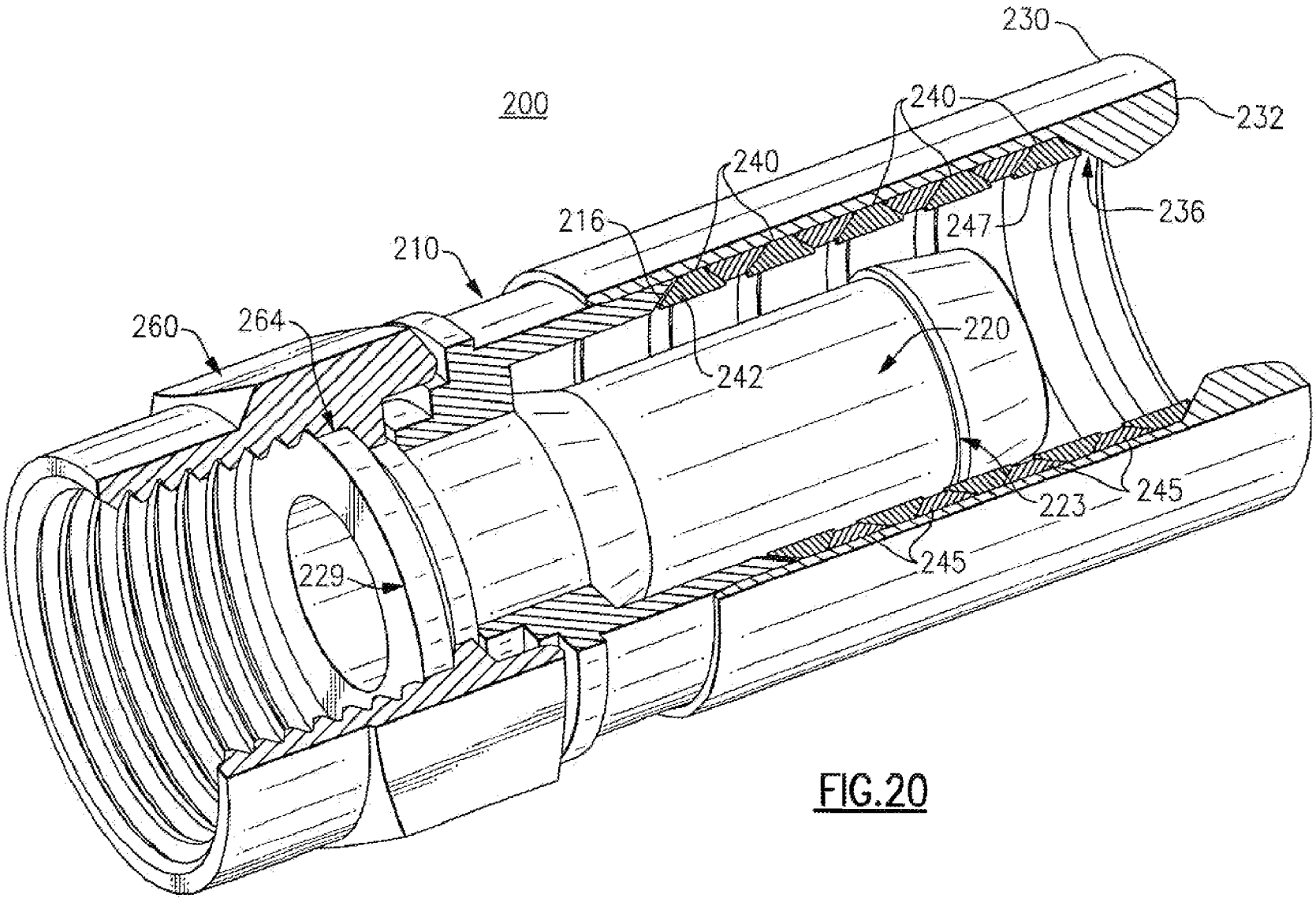
FIG. 20 shows a partial cutaway perspective view of a further alternative embodiment of the invention.

The compression member 230 is also generally tubular in shape and is operatively engaged with the connector body. The engagement may take several forms, but in FIGS. 16-18 and 20 is shown as a press fit in a preinstalled configuration. The embodiments of the invention depicted in FIGS. 7-15 and described above utilize a threaded engagement between the connector body and compression fitting or nut. Other means of engagement generally known in the art include interference fits between corresponding ridges and grooves on the radially adjacent parts, such as used in U.S. Pat. No. 5,470,257 to Szegda, or the use of interlocking ridges, catches or detents as shown in U.S. Pat. No. 6,153,830 to Montena, each of which is incorporated herein by reference. The compression member 230 and the radially adjacent connector body 210 may be engaged either with the compression member axially slid inside the connector body as shown in FIG. 16, or with the compression member axially slid over the connector body as shown in FIG. 20. The distal end of the compression member may include a flat surface 232 for engagement with any number of axial compression tools commercially available for use with axial compression connectors.

Figure 17:
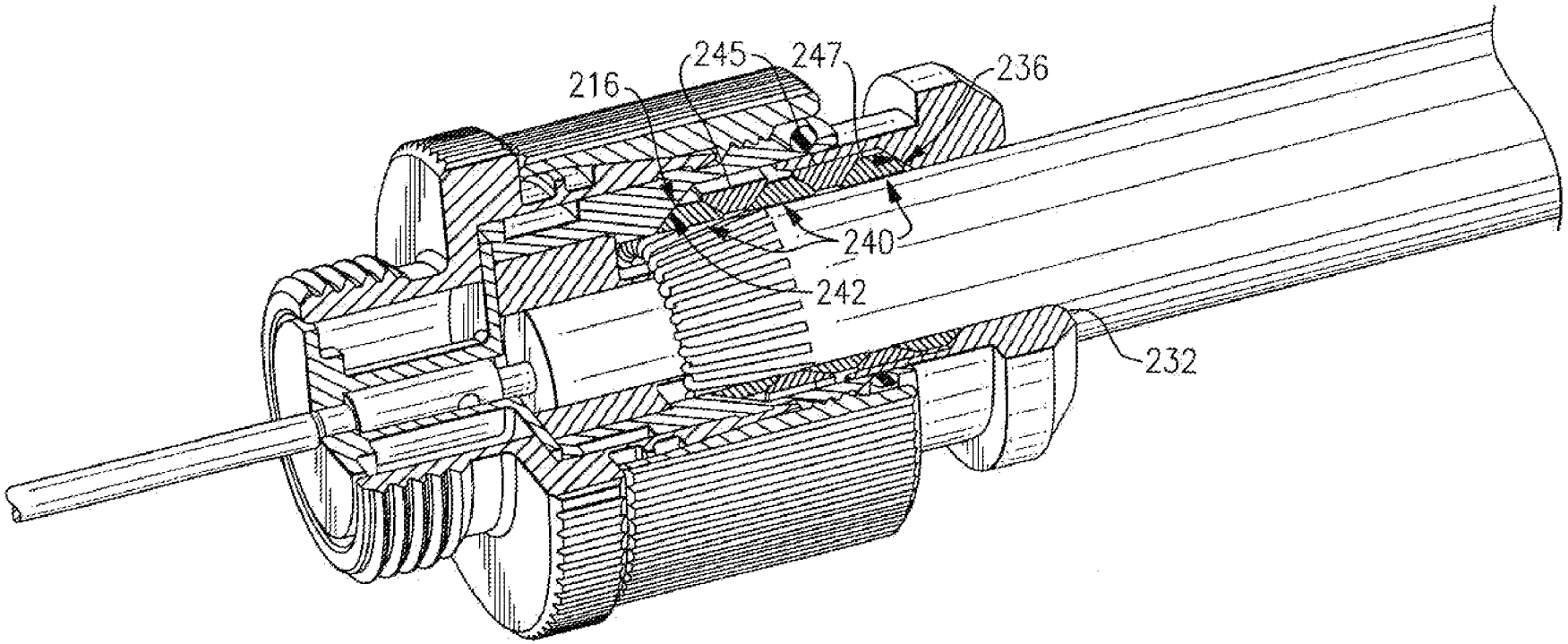
FIG. 17 shows a partial cutaway perspective view of the alternative embodiment of FIG. 16 placed over the prepared end of a coaxial cable.
Figure 21:
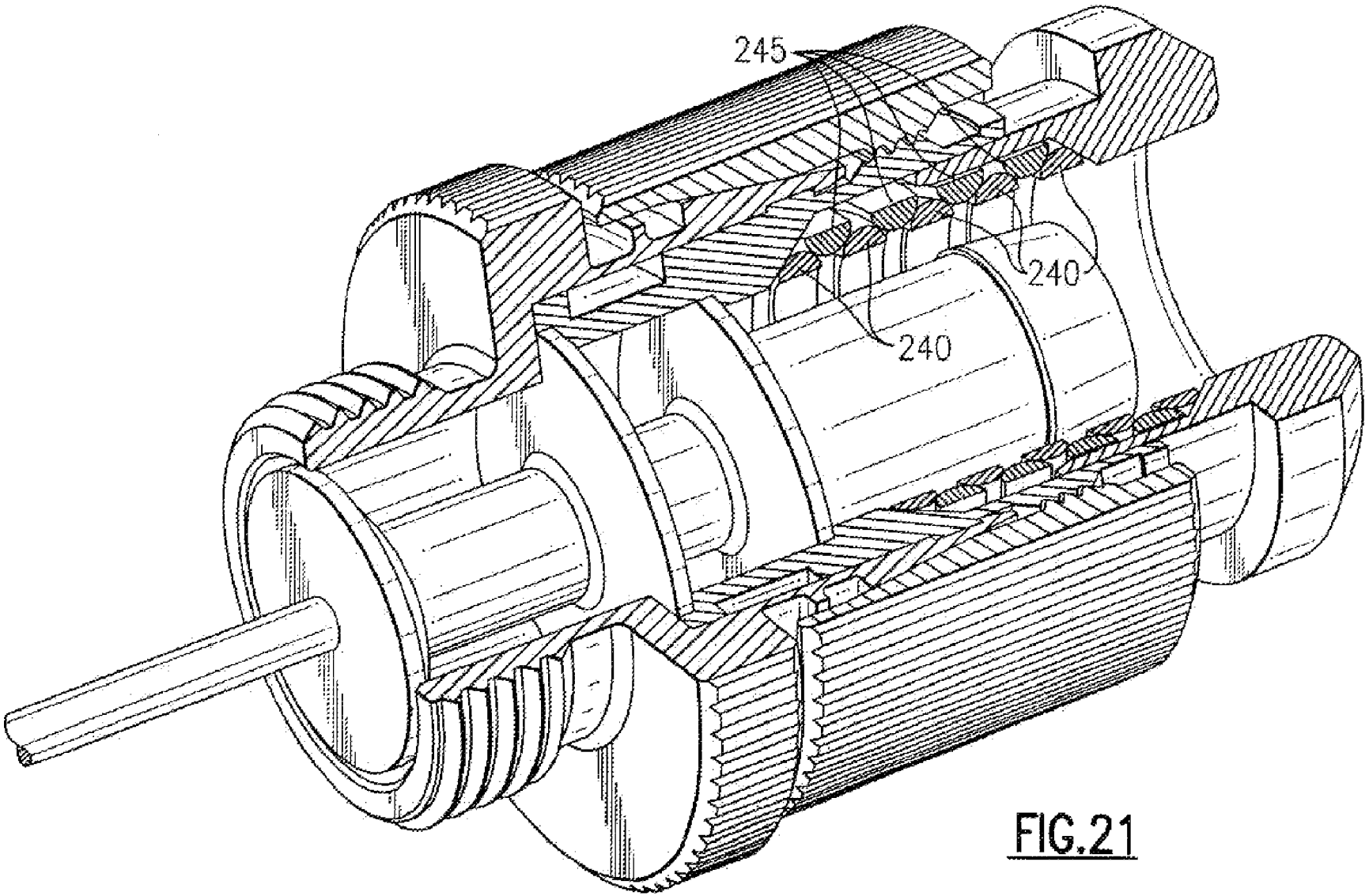
FIG. 21 shows a partial cutaway perspective view of the alternative embodiment of FIG. 16 with the plurality of rings having an alternative cross-sectional shape.
Figure 22:
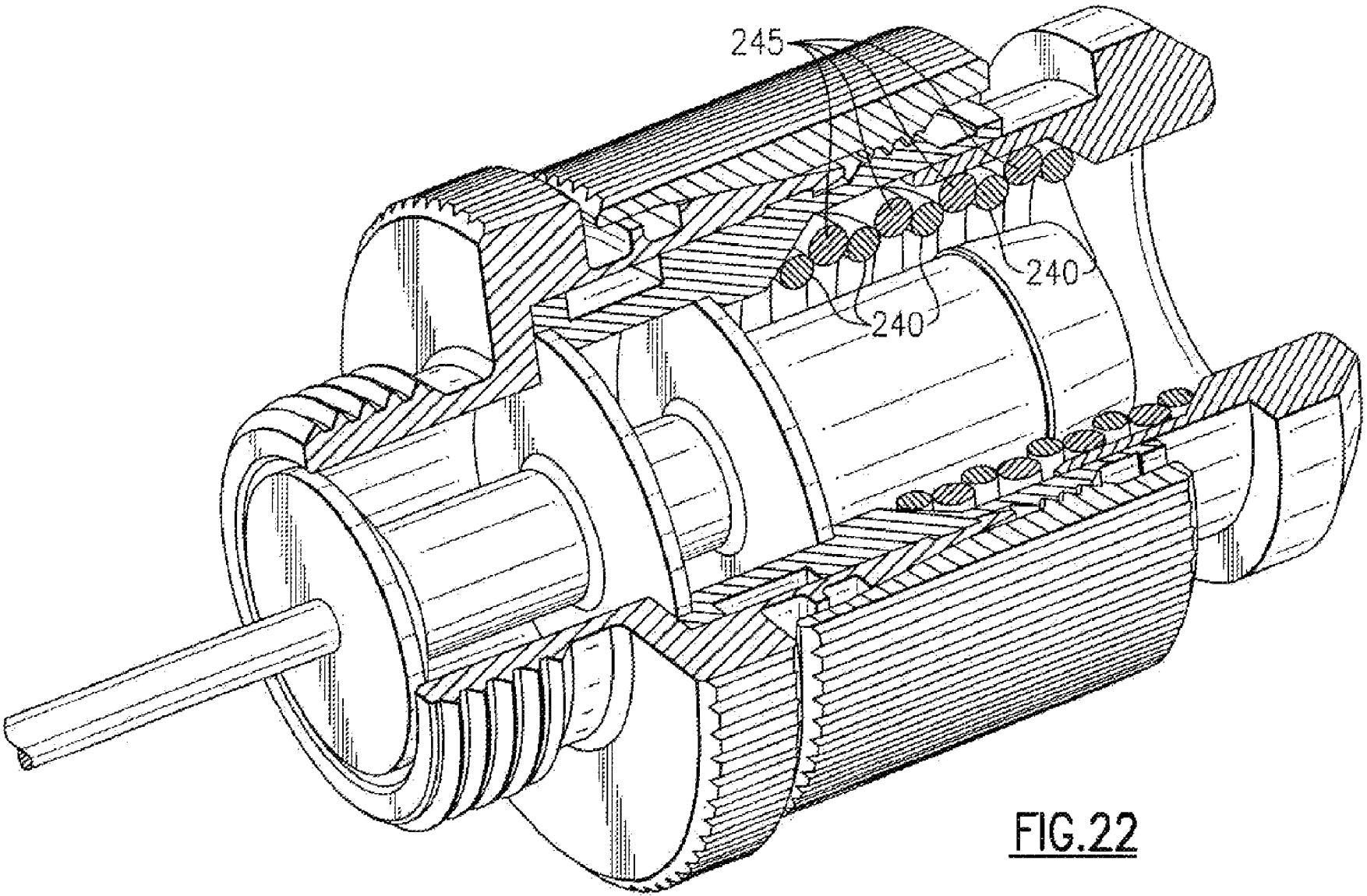
FIG. 22 shows a partial cutaway perspective view of the alternative embodiment of FIG. 16 with the plurality of rings having a further alternative cross-sectional shape.

Referring to FIG. 17, the alternative embodiment also includes a plurality of rings comprised of both inner rings 240 and outer rings 245 that are disposed radially inward of the connector body 210 and compression member 230 and radially outward of at least a portion of the mandrel 220. In the preferred embodiment, both the inner rings 240 and outer rings 245 are wedged shaped, i.e., shaped substantially as trapezoids, with adjacent rings touching each other via mating, tapered sides. However, it is anticipated that other cross-sectional shapes that include both tapered and non-tapered sides, such as circular, partially circular, oval, triangular, or pie-shaped, could be arranged that would grip and seal the cable as long as the configuration of rings is capable of a wedging engagement or relationship. For example, in FIG. 21, the plurality of rings is shown with an alternative cross-sectional shape that is semi-circular. The flat sides of the inner rings 240 are positioned inward toward the cable and the flat sides of the outer rings are positioned outward toward the compression member and the connector body. Upon the axial movement of the compression member, the inner and outer rings are driven into a wedging engagement such that the flat side of the inner rings are compressed against and form a seal with the outer jacket 168 of the coaxial cable. Similarly in FIG. 22, the plurality of rings is shown with an alternative cross-sectional shape that is fully circular. In this embodiment using rings with circular cross-sections, the inner rings 240 and outer rings 245 must be sized and configured such that the outer rings contact the inner rings at a point radially outward of the cross-sectional diameter of the inner rings that is parallel to the central longitudinal axis of the connector. Thus, upon axial movement of the compression member, a wedging engagement of the rings is created as the outer rings exert a radially inward force upon the inner rings which are compressed against the outer jacket of the coaxial cable.

In this embodiment, both the inner rings 240 and the outer rings 245 are fully circular (see FIG. 19) and composed of deformable material, preferably plastic. As the grounding path in this embodiment is well established through the mandrel 220 and connector body 210, all of the rings can be formed of nonconductive deformable material. However, it is anticipated that the mandrel 220 could be formed of nonconductive material and an electrical ground path could be established between the folded over wire mesh 166 and either the inner surface of the connector body 210 or through least one electrically conductive ring that is in contact with the connector body, such as the innermost ring 242. See FIG. 18.

Figure 18:
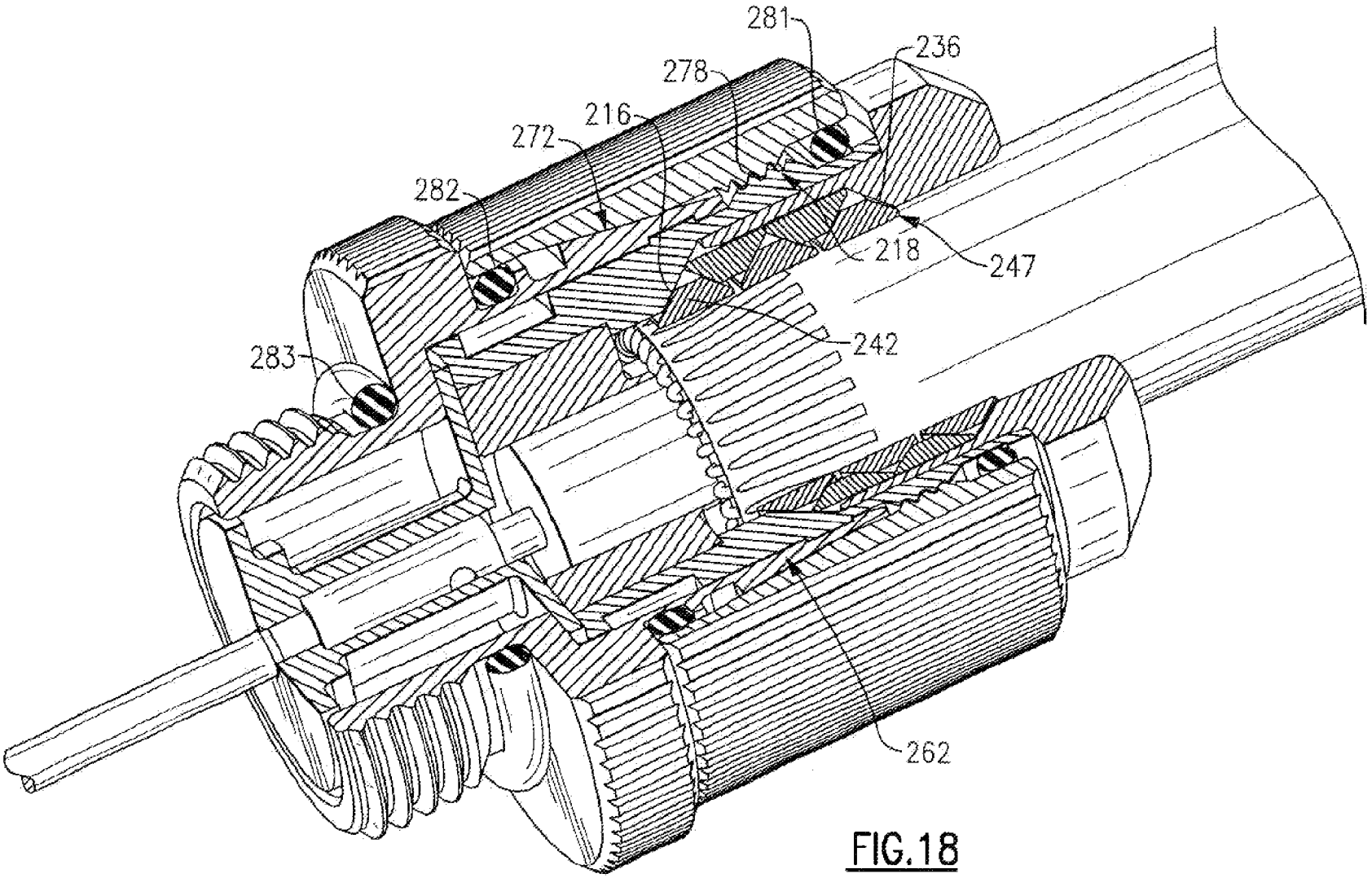
FIG. 18 shows a partial cutaway perspective view of the alternative embodiment of FIG. 16 installed on a coaxial cable.
Figure 19:
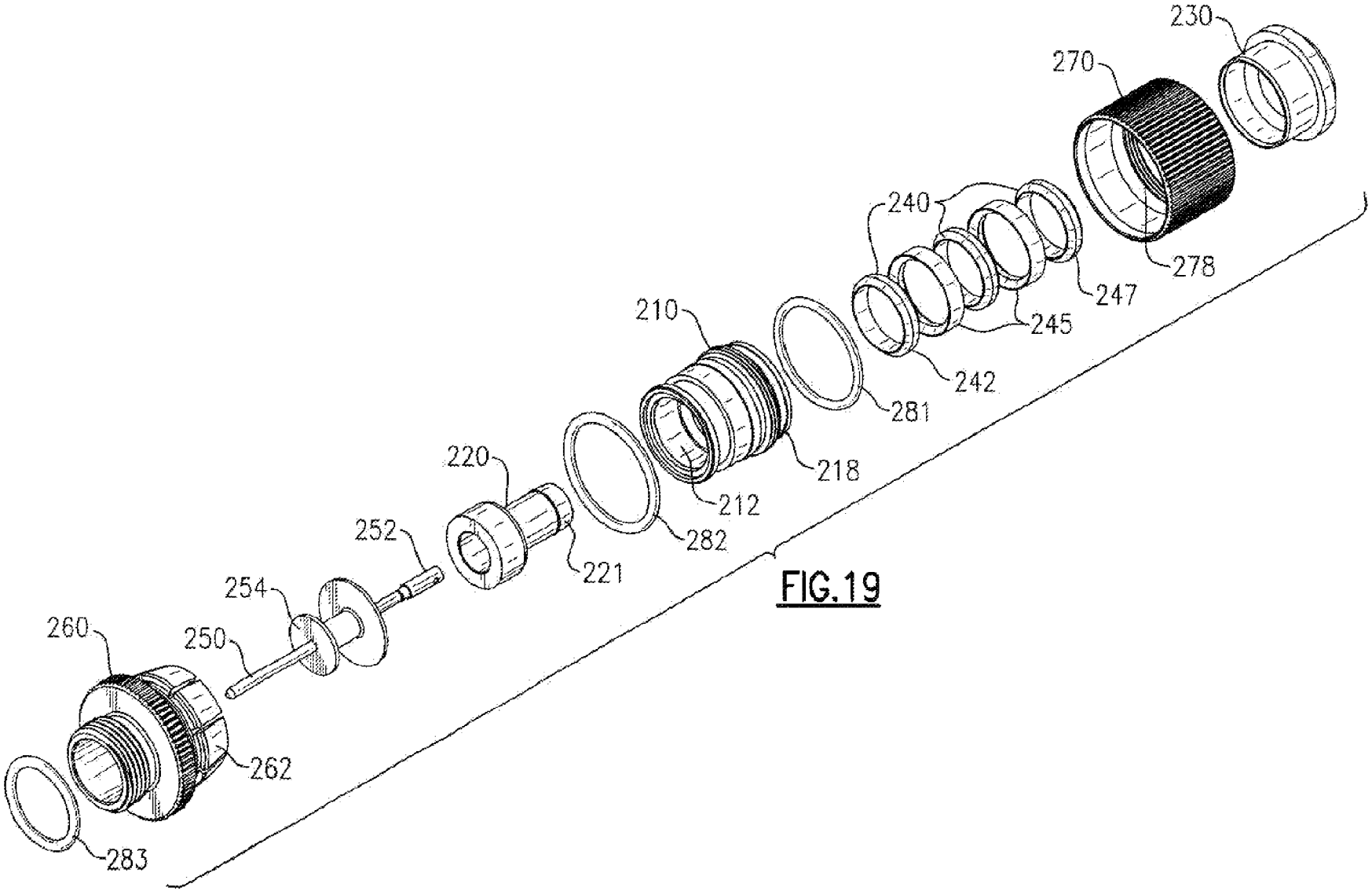
FIG. 19 shows an exploded perspective view of the alternative embodiment of FIG. 16.

As further depicted in FIG. 18, the inner surface of the compression member includes a shoulder 236, which in the preferred embodiment is tapered to mate with the tapered side of outermost ring 247. Similarly, the inner surface of the connector body also includes a second shoulder 216, which again in the preferred embodiment is tapered to mate with the tapered side of the innermost ring 242. As the compression member 230 is axially slid toward the connector body 210, the shoulder 236 on the inner surface of the compression member 230 drives the inner rings 240 and outer rings 245 into wedging engagement with each other. The innermost ring 242 is also driven against the second shoulder 216 on the connector body. The axial force acting upon the tapered side surfaces of the rings causes the inner rings 240 to deform radially inward and compress against the coaxial cable 160. The outer rings are constrained by the inner surfaces of the connector body 210 and/or the compression member 230 and hold the inner rings 240 compressed against the cable jacket 168 to form a continuous 360 degree seal that prevents moisture from entering the connection and potentially degrading the quality of the cable signal.

The particular embodiment of the connector shown in FIGS. 16-19 has a KS-type interface that is known in the art. The KS-type interface connects the center conductor 162 of the coaxial cable to transmit the cable signal to a piece of equipment in the cable system through a contact pin 250 that may also include a collet 252 for maintaining secure contact between the contact pin 250 and the center conductor 162. The contact pin is electrically isolated from the grounding path by an insulator 254.

The KS-type interface also includes a swivel nut 260 that attaches the connector to an equipment port or other cable and that, in the preferred alternative embodiment, completes the grounding path via electrical contact from the outer conductor 166 with the connector body 210 and/or the mandrel 220. With a KS-type interface, the swivel nut is first threaded onto the equipment port. The jam nut 270 is then advanced by the relative rotation of corresponding threads 218 and 278 on the connector body 210 and the inner surface of the jam nut 270, respectively. As the jam nut 270 threadedly advances, the tapered inner surface 272 of the jam nut constricts the rear portion 262 of the swivel nut 260 to prevent further independent rotation of the swivel nut.

Sealing members 281, 282 and 283 may also be added between various connector components to inhibit the infiltration of moisture and other contaminants into the cable connection. The sealing members of the preferred alternative embodiment are depicted as O-rings. Referring to FIG. 18, sealing member 281 forms a seal between compression member 230 and the jam nut 270. Sealing member 282 forms a seal between the swivel nut 260 and the jam nut 270. Sealing member 283 forms a seal between the swivel nut 260 and the equipment port (not shown).

While this preferred alternative embodiment is depicted with a KS-type interface incorporating a swivel nut 260 and a jam-nut 270, the invention is not dependent on the particular type of cable connector interface shown, but is applicable to any connection between a cable and a cable connector. It is appreciated by those skilled in the art that the novel manner in which the cable is secured, sealed and electrically engaged between the mandrel and plurality of rings is suitable for other known connector interfaces, such as DIN, SMA, N, BNC, RCA, and F type, male and female interfaces.

A further alternative embodiment of the invention is shown in FIG. 20. This connector is particularly suited for use with flexible coaxial cable such as that used on drop lines from a directional tap to connect, for example, an individual subscriber's premises to CATV subscription services. This embodiment utilizes an F-type interface that includes a hexagonal nut 260, although knurled and splined nuts may also be used. Alternatively BNC or RCA type interfaces are frequently used to quickly interconnect various pieces of equipment, for example, in a laboratory setting. With the exception of the particular type of connector interface, this embodiment functions substantially the same as the embodiment depicted in FIGS. 16-19 described above and, therefore, the same reference numerals will be used to identify similar components and features wherever possible.

The embodiment of FIG. 20 includes a connector body 210, a mandrel 220 and compression member 230. The connector body has a first shoulder 214 at the proximal end through which the mandrel 220 is press fitted. The mandrel 220 includes a flange 227 at the proximal end that cooperates with a shoulder 264 on the inner surface of the nut 260 which allows the nut 260 to rotate independently of the connector body 210 and cable 160. At the distal end, the mandrel includes a barb 223 that is inserted between the wire mesh outer conductor of a flexible coaxial cable and the dielectric layer 164. The shape of the barb or serration assists in retaining the distal end of the mandrel between the dielectric layer 164 and wire mesh portion 166 of the outer conductor.

The compression member 230 of this embodiment is press fitted over the distal end of the connector body in a preinstalled configuration although other means of engagement known in the prior art and discussed above are likewise suitable. The compression member has a flat distal end 232 for engagement with a corresponding axial compression tool of which there are many known in the art.

The connector further includes a plurality of inner rings 240 and outer rings 245 with substantially wedge-shaped cross sections. Both the inner rings 240 and outer rings 245 are fully circular and composed of a deformable material, preferably plastic. The rings are disposed radially between the mandrel 220 and the compression member 230. While the particular embodiments depicted in FIGS. 7-22 depict a plurality of between five and nine rings, the advantages of the present invention, including distributing the clamping and sealing forces over a relatively larger longitudinal portion of the cable between the mandrel and the rings, can be achieved with as few as two inner rings and one outer ring interleaved between them. However, it would be recognized by those skilled in the art that clamping and sealing forces are more likely to be uniform along the cable when there are a larger number of rings.

The interior surface of the compression member includes a shoulder 236 which is preferably tapered to mate with the tapered surface of the outermost ring 247. Similarly, the distal end of the connector body 216 includes a tapered surface that mates with the tapered surface of the innermost ring 242.

A prepared end of a coaxial cable 160 as depicted in FIG. 16 is inserted in the distal end of the connector such that the center conductor 162, dielectric layer 164 and any layers of conductive foil 165 are inserted into the mandrel 220 while the wire mesh 66 portion of the outer conductor and the cable jacket 168 are inserted radially outward of the mandrel 220 and radially inward of the connector body 210, plurality of rings 240, 245 and compression member 230. An axial compression tool is used to slide the compression member axially over the connector body. The tapered shoulder 236 of the compression member drives the interleaved inner rings 240 and outer rings 245 into wedging engagement with each other. The innermost ring 242 is driven against the tapered distal end of the connector body. The axial force applied to the tapered surfaces of the rings causes the inner rings 240 to deform radially inward against the cable 160. The outer rings 245 are constrained against the compression member 230 and/or the connector body 210 and hold the inner rings 240 compressed against the cable. The radially deformed rings 240 form a continuous 360 degree seal against the cable jacket 168 to prevent the infiltration of moisture and other contaminants between the rings and the cable jacket. The compression of the outermost ring 247 by the shoulder 236 of the compression member similarly forms a seal therebetween. Finally, the wedging engagement of the innermost ring 242 between its adjacent outer ring and the distal end of the connector body will form an effective seal to inhibit the infiltration of moisture through the engagement between the connector body and the compression member.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. An end connector for coaxial cable having a central conductor surrounded by a dielectric layer and an outer conductor surrounding the dielectric layer, said end connector comprising:

a connector body having a threaded portion configured for engagement with an equipment port and an inner cavity for receiving an end of a coaxial cable;

a mandrel disposed within said cavity, said mandrel having a first end for insertion beneath the outer conductor of said coaxial cable;

a plurality of annular rings that are located within the inner cavity and are interleaved with one another so that side surfaces of adjacent rings are disposed in a wedging relationship, and wherein each of said rings is manufactured as a one-piece component that substantially surrounds said coaxial cable; and a compression member that is operatively engaged to said connector body and configured for applying an axial force to drive said plurality of rings into a wedging engagement with each other and whereby at least two of said plurality of rings compress against said coaxial cable; wherein the plurality of annular rings include a plurality of annular inner rings and at least one annular outer ring.

2. An end connector according to claim 1, wherein said annular rings have a cross-sectional shape from the group of wedge-shaped, trapezoidal, triangular, rounded, semi-circular and circular.

3. An end connector according to claim 1, wherein an annular inner ring has a single slot to facilitate the compression of said annular inner ring against the cable.

4. An end connector according to claim 3, wherein each annular inner ring has a single slot to facilitate the compression of said inner ring each annular against the cable.

5. An end connector according to claim 1, wherein at least one of said inner rings is composed of electrically conductive material.

6. An end connector according to claim 1, wherein at least one annular inner ring is comprised of a deformable plastic material to facilitate the compression of said inner ring against the cable.

7. An end connector of claim 6 wherein upon driving the plurality of rings into wedging engagement, said deformable ring forms a continuous seal against the cable.

8. An end connector according to claim 1, wherein the threaded portion of the connector body has external threads.

9. An end connector according to claim 1, wherein the threaded portion of the connector body is an internally threaded nut.

10. An end connector according to claim 9, further including a sealing member adjacent to said nut.

11. An end connector according to claim 1, further comprising a conductive pin electrically engaging the center conductor of the coaxial cable; and an insulator to electrically isolate the conductive pin from the connector body.

12. An end connector according to claim 11, wherein the conductive pin includes a collet for receiving an end of the center conductor of the coaxial cable.

13. An end connector according to claim 1, wherein the compression member is threadably advanced over the connector body.

14. An end connector according to claim 1, wherein the compression member is threadably advanced into the cavity of the connector body.

15. An end connector according to claim 1, wherein the compression member slides axially into the cavity of the connector body.

16. An end connector according to claim 1, wherein the compression member is slides axially over the connector body.

17. An end connector for coaxial cable having a central conductor surrounded by a dielectric layer and an outer conductor surrounding the dielectric layer, said end connector comprising:

a connector body having an inner cavity;

means for attaching said connector body to an equipment port;

a mandrel disposed within said cavity, said mandrel having a first end for insertion beneath the outer conductor at the end of the coaxial cable;

a plurality of annular outer rings located within the inner cavity, each outer ring having an inner surface, an outer surface, and side surfaces, wherein the inner surface is narrower than the outer surface;

a plurality of annular inner rings located within the inner cavity, each inner ring having an inner surface and an outer surface wherein the outer surface is narrower than the inner surface, said inner rings are interleaved with said outer rings so that side surfaces of adjacent the inner and outer rings are disposed in a wedging relationship; and a compression member that is operatively engaged to said connector body and configured for applying an axial force to drive said inner and outer rings into a wedging engagement with each other and whereby at least two of said plurality of annular inner rings compress against said coaxial cable in response to said axial force.

18. The cable connector of claim 17 where said rings are configured to have an inner surface that faces said coaxial cable and that is substantially flat and ungrooved.

19. An end connector for coaxial cable having a central conductor surrounded by a dielectric layer and an outer conductor surrounding the dielectric layer, said end connector comprising:

a connector body having an inner cavity;

a mandrel comprised of electrically conductive material fitted inside said cavity for receiving a prepared coaxial cable end at an end of said connector body;

a plurality of inner rings operatively associated with a plurality of outer rings, said inner and outer rings being located within the inner cavity and interleaved with one another so that side surfaces of adjacent rings are in a wedging relationship; and a compression member disposed radially adjacent to said connector body for sliding axial movement relative to the connector body whereby said inner and outer rings are driven into wedging engagement with each other and whereby at least two of said plurality of inner rings compress against said coaxial cable.

* * * * *